US008998198B2

(12) United States Patent
Yamajo et al.

(10) Patent No.: US 8,998,198 B2
(45) Date of Patent: Apr. 7, 2015

(54) SHEET SORTING DEVICE

(71) Applicant: Riso Kagaku Corporation, Tokyo (JP)

(72) Inventors: Takeshi Yamajo, Ibaraki (JP); Hiroshi Sugitani, Ibaraki (JP); Masashi Hara, Ibaraki (JP); Hitoshi Arai, Ibaraki (JP); Kenji Obata, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 13/973,153

(22) Filed: Aug. 22, 2013

(65) Prior Publication Data

US 2014/0062014 A1 Mar. 6, 2014

(30) Foreign Application Priority Data

Aug. 28, 2012 (JP) ..... 2012-187506

(51) Int. Cl.

| | |
|---|---|
| ***B65H 31/00*** | (2006.01) |
| ***B65H 31/24*** | (2006.01) |
| ***B65H 29/70*** | (2006.01) |
| ***B65H 31/10*** | (2006.01) |
| ***B65H 31/34*** | (2006.01) |
| ***B65H 33/08*** | (2006.01) |

(52) U.S. Cl.

CPC ..... *B65H 31/24* (2013.01); *B65H 29/70* (2013.01); *B65H 31/10* (2013.01); *B65H 31/34* (2013.01); *B65H 33/08* (2013.01); *B65H 2301/42194* (2013.01); *B65H 2301/42252* (2013.01); *B65H 2301/51214* (2013.01); *B65H 2301/5133* (2013.01); *B65H 2301/5321* (2013.01); *B65H 2404/7412* (2013.01); *B65H 2404/743* (2013.01); *B65H 2405/1122* (2013.01); *B65H 2405/1134* (2013.01); *B65H 2405/1136* (2013.01); *B65H 2405/114* (2013.01); *B65H 2405/11425* (2013.01); *B65H 2405/15* (2013.01); *B65H 2511/12* (2013.01); *B65H 2511/13* (2013.01); *B65H 2511/222* (2013.01); *B65H 2513/514* (2013.01); *B65H 2601/255* (2013.01); *B65H 2601/273* (2013.01); *B65H 2801/06* (2013.01); *B65H 2801/15* (2013.01); *B65H 2801/18* (2013.01); *B65H 2601/111* (2013.01)

(58) Field of Classification Search

USPC ..... 271/207, 213, 214, 215, 217, 220, 221, 271/222, 223, 224; 399/403–405; 414/791.2

See application file for complete search history.

(56) References Cited

U.S. PATENT DOCUMENTS

| | | | | |
|---|---|---|---|---|
| 4,867,436 | A * | 9/1989 | Hanada et al. | 271/221 |
| 4,905,979 | A * | 3/1990 | Limbach et al. | 271/176 |
| 8,315,550 | B2 * | 11/2012 | Pinney et al. | 399/404 |
| 2008/0230984 | A1 * | 9/2008 | Kobayashi | 271/220 |

FOREIGN PATENT DOCUMENTS

| | | |
|---|---|---|
| JP | 2008-201590 | 9/2008 |

* cited by examiner

*Primary Examiner* — Thomas Morrison
(74) *Attorney, Agent, or Firm* — Greenblum & Bernstein, P.L.C.

(57) ABSTRACT

A controller temporarily opens a pair of side fence plates under a prescribed condition to move the side fence plates away from both side ends of sheets in a sheet width direction, after each time stacking of sheets at a first or second sheet stacking position is completed, but before a sheet receiving tray is temporarily lifted down to offset an offset guide plate and an end fence plate. Else, the controller sets an amount of lifting up and down of the sheet receiving tray such that the amount at the second sheet stacking position is smaller than that at the first sheet stacking position when offsetting the offset guide plate and the end fence plate after each time the stacking of sheets at the first or second sheet stacking position on the sheet receiving tray is completed.

5 Claims, 15 Drawing Sheets

SHEET SORTING DEVICE

CROSS REFERENCE TO RELATED APPLICATION

This application is based upon and claims the benefit of priority from the prior Japanese Patent Application No. 2012-187506, filed on Aug. 28, 2012, the entire contents of which are incorporated herein by reference.

BACKGROUND

1. Technical Field

The present invention relates to a sheet sorting device configured to sort sheets discharged from an image forming device by stacking the sheets alternately at a first sheet stacking position and a second sheet stacking position.

2. Related Art

The image forming device is capable of forming images on sheets by using a printing device, such as an inkjet printer, a stencil printing device or a laser printer, a copier or the like, and performs printing or copying on many sheets. There are proposed various sheet sorting devices which can sort such a large number of sheets discharged from the image forming device, for example, into multiple sets of a predetermined number of sorted sheets or can sort and stack sets of sheets for respective jobs on a sheet receiving tray.

As one of such sheet sorting devices, Japanese Patent Application Publication No. 2008-201590 proposes a sheet receiving device capable of sorting of many sheets in an orderly manner.

Although an illustration is omitted herein, a first embodiment of the sheet receiving device (sheet sorting device) disclosed in Japanese Patent Application Publication No. 2008-201590 includes a sheet receiving tray, a contacting guide plate (offset guide plate), a stopping guide plate (end fence plate), a pair of width guide plates (pair of side fence plates), and a sheet receiving tray control means. The sheets sequentially discharged from a sheet discharging unit of a sheet processing device are stacked on the sheet receiving tray. The contacting guide plate is installed below the sheet discharging unit of the sheet processing device to be movable to offset positions, and aligns rear ends of the sheets in a sheet discharging direction. The stopping guide plate is provided to face the contacting guide plate at an interval equal to the length of the sheets and is suspended to be movable to offset positions, from a sheet receiving cover provided above the sheet receiving tray. The stopping guide plate aligns front ends of the sheets in the sheet discharging direction. The pair of width guide plates are suspended from the sheet receiving cover to be movable in a sheet width direction orthogonal to the sheet discharging direction, and align both side ends of the sheets in the sheet width direction. The sheet receiving tray controlling means lifts down the sheet receiving tray with progress of the stacking of the sheets onto the sheet receiving tray.

In the first embodiment of the sheet receiving device described above, sorting of sheets is performed in such a way that the sheets sequentially discharged from the sheet discharging unit of the sheet processing device are made to fall to the sheet receiving tray and are stacked alternately at a first sheet stacking position and a second sheet stacking position. On the sheet receiving tray, the first sheet position is set to be on the upstream side in the sheet discharging direction and the second sheet stacking position is set to be offset downstream of the first sheet stacking position by a predetermined amount. In the sheet sorting, after the completion of the sheet sorting at the first sheet stacking position (or the second sheet stacking position), the sheet receiving tray is temporarily lifted down before the contacting guide plate and the stopping guide plate are offset to a front side (or a rear side) in the sheet discharging direction by the predetermined amount to serve for the second sheet stacking position (or the first sheet stacking position). Then, the sheet receiving tray is lifted up after the contacting guide plate and the stopping guide plate are offset. Thus, the top sheet among the sheets stacked on the sheet receiving tray does not come into contact with either of the contacting guide plate and the stopping guide plate when the contacting guide plate and the stopping guide plate are offset. Accordingly, the contacting guide plate and the stopping guide plate can be surely offset by the predetermined offset amount alternately to the rear side or the front side in the sheet discharging direction.

SUMMARY

In the first embodiment of the sheet receiving device disclosed in Japanese Patent Application Publication No. 2008-201590 described above, many sheets can be sorted on the sheet receiving tray. However, when the sheet receiving tray is temporarily lifted down as described above after each time the sheet sorting at the first or second sheet stacking position is completed, a phenomenon sometimes occurs in which some of the sheets stacked on the sheet receiving tray in the sheet sorting remain caught by the pair of width guide plates.

In this case, the sheets caught by the pair of width guide plates hit the contacting guide plate and/or the stopping guide plate and are damaged. In addition, the sheets caught by the pair of width guide plates become obliquely arranged to cause stacking failure on the sheet receiving tray.

Moreover, after each time the sheet sorting at the first or second sheet stacking position is completed, the sheet receiving tray is temporarily lifted down, the contacting guide plate and the stopping guide plate are offset to the front or rear side in the sheet discharging direction by the predetermined amount, and the sheet receiving tray is lifted up after the contacting guide plate and the stopping guide plate are offset. The productivity of the sheet receiving device is greatly affected by a time required for lifting up and down the sheet receiving tray and for offsetting the contacting guide plate and the stopping guide plate which are performed after each time the sheet sorting at the first or second sheet stacking position is completed. Accordingly, it is preferable to make this time as short as possible.

An object of the present invention is to provide a sheet sorting device capable of preventing sheet stacking failure on a sheet receiving tray even if a phenomenon in which a sheet remains caught by a pair of width guide plates (pair of side fence plates) occurs in sheet sorting in which sheets sequentially discharged from the image forming device are made to fall to a sheet receiving tray and are stacked alternately at a first sheet stacking position set to be on an upstream side in the sheet discharging direction on the sheet receiving tray and at a second sheet stacking position set to be offset downstream of the first sheet stacking position by a predetermined amount.

Moreover, another object of the present invention is to provide a sheet sorting device capable of reducing a time required for lifting up and down the sheet receiving tray and offsetting a contacting guide plate and a stopping guide plate which are performed after each time the sheet sorting at the first or second sheet stacking position is completed.

A sheet sorting device in accordance with some embodiments includes: a sheet receiving tray configured to stack sheets sequentially discharged and falling from an image forming device alternately at a first sheet stacking position located upstream in a sheet discharging direction and at a second sheet stacking position offset downstream of the first sheet stacking position by a predetermined amount; a pair of side fence plates provided in parallel with the sheet discharging direction above the sheet receiving tray, to face each other at an interval and to be movable in a sheet width direction orthogonal to the sheet discharging direction, the side fence plates being configured to align both side ends, in the sheet width direction, of the sheets stacked on the sheet receiving tray; a side fence plate opening-closing unit configured to selectively open and close the pair of side fence plates between a position where the pair of side fence plates are away from the both side ends, in the sheet width direction, of the sheets stacked on the sheet receiving tray and a position where the pair of side fence plates are in contact with the both side ends, in the sheet width direction, of the sheets stacked on the sheet receiving tray; an offset guide plate movably installed at a position located upstream in the sheet discharging direction above the sheet receiving tray and configured to align rear ends, in the sheet discharging direction, of the sheets stacked on the sheet receiving tray; an offset guide plate moving unit configured to offset the offset guide plate to locations for the first sheet stacking position and the second sheet stacking position; an end fence plate provided above the sheet receiving tray to face the offset guide plate at an interval equal to a length of the sheets in the sheet discharging direction and to be movable in the sheet discharging direction, the end fence plate being configured to align front ends, in the sheet discharging direction, of the sheets stacked on the sheet receiving tray; an end fence plate moving unit configured to offset the end fence plate to locations for the first sheet stacking position and the second sheet stacking position; a sheet receiving tray lifting unit configured to liftably support the sheet receiving tray; and a controller configured to control the side fence plate opening-closing unit, the offset guide plate moving unit, the end fence plate moving unit, and the sheet receiving tray lifting unit. The controller is configured to: (a) while the sheets are discharged from the image forming device and are stacked on the sheet receiving tray at the first and second sheet stacking positions, drive the sheet receiving tray lifting unit to lift the sheet receiving tray down to keep a constant falling height of a top sheet stacked on the sheet receiving tray; (b) after each time when stacking of the sheets at the first sheet stacking position is completed and when the second sheet stacking position is completed, drive the side fence plate opening-closing unit to temporarily open the pair of side fence plates under a prescribed condition to move the pair of side fence plates away from the both side ends, in the sheet width direction, of the sheets; (c) after the step (b), drive the sheet receiving tray lifting unit to temporarily lift the sheet receiving tray down; (d) after the step (c), drive the offset guide plate moving unit to offset the offset guide plate and drive the end fence plate moving unit to offset the end fence plate; (e) after the step (d), drive the sheet receiving tray lifting unit to lift the sheet receiving tray up; and (f) after the step (e), drive the side fence plate opening-closing unit to close the pair of side fence plates to bring the pair of side fence plates into contact with the both side ends, in the sheet width direction, of the sheets again.

In the configuration described above, the sheet sorting is performed in such a way that the sheets sequentially discharged from the image forming device are made to fall to the sheet receiving tray and are stacked alternately at the first sheet stacking position set on the sheet receiving tray on the upstream side in the sheet discharging direction and at the second sheet stacking position set to be offset downstream of the first sheet stacking position by the predetermined amount. In the sheet sorting, particularly, after every time the sheet sorting at the first or second sheet stacking position (sheet stacking at the first or second sheet stacking position) is completed, the controller: temporarily opens the pair of side fence plates in such a way that the pair of side fence plates move away from both side ends of the sheets in the width direction; thereafter temporarily lifts down the sheet receiving tray and offsets the offset guide plate and the end fence plate; and then closes the pair of side fence plates again after lifting up the sheet receiving tray. Accordingly, when the pair of side fence plates are temporarily opened, the alignment of both side ends of the sheets in the width direction by the pair of side fence plates is released. This can release the sheets caught by the pair of side fence plates in the sheet sorting, and eliminate sheet damage and sheet stacking misalignment due to oblique falling of sheets.

An opening amount for temporarily opening the pair of side fence plates may depend on a size or a paper quality of the sheets to be discharged.

In the configuration described above, the opening amount in the temporary opening of the pair of side fence plates is varied according to the size of the sheets or the paper quality of the sheets. Accordingly, the sheet stacking failure on the sheet receiving tray can be prevented according to the size of the sheets or the paper quality of the sheets.

The prescribed condition may include a paper quality of the sheets to be discharged.

According to the configuration described above, the execution and non-execution of the opening-closing operation of the pair of side fence plates after the completion of the sheet stacking is set according to the paper quality of the sheets. Accordingly, sheet stacking failure on the sheet receiving tray can be prevented according to the paper quality of the sheets.

A sheet sorting device in accordance with some embodiments includes: a sheet receiving tray configured to stack sheets sequentially discharged and falling from an image forming device alternately at a first sheet stacking position located upstream in a sheet discharging direction and at a second sheet stacking position offset downstream of the first sheet stacking position by a predetermined amount; an offset guide plate movably installed at a position located upstream in the sheet discharging direction above the sheet receiving tray and configured to align rear ends, in the sheet discharging direction, of the sheets stacked on the sheet receiving tray; a first sheet contacting member movably attached to a lower portion of the offset guide plate and configured to be lowered toward the sheet receiving tray to align the rear ends, in the sheet discharging direction, of the sheets in conjunction with the offset guide plate; an offset guide plate moving unit configured to offset the offset guide plate and the first sheet contacting member to locations for the first sheet stacking position and the second sheet stacking position; an end fence plate provided above the sheet receiving tray to face the offset guide plate at an interval equal to a length of the sheets in the sheet discharging direction and to be movable in the sheet discharging direction, the end fence plate being configured to align front ends, in the sheet discharging direction, of the sheets stacked on the sheet receiving tray; a second sheet contacting member moveably attached to a lower portion of the end fence plate and configured to be lowered toward the sheet receiving tray to align the front ends, in the sheet discharging direction, of the sheets in conjunction with the end fence plate; an end fence plate moving unit configured to offset the end fence plate and the second sheet contacting member to locations for the first sheet stacking position and the second sheet stacking position; a sheet receiving tray lifting unit configured to liftably support the sheet receiving tray; and a controller configured to control the offset guide plate moving unit, the end fence plate moving unit, and the sheet receiving tray lifting unit. The controller is configured to: (a) while the sheets are delivered from the image forming device and are stacked on the sheet receiving tray at the first and second sheet stacking positions, drive the sheet receiving tray lifting unit to lift the sheet receiving tray down to keep a constant falling height of a top sheet stacked on the sheet receiving tray; (b) after stacking of the sheets at the first sheet stacking position is completed, drive the sheet receiving tray lifting unit to temporarily lift the sheet receiving tray down by a first amount; (c) after the step (b), drive the offset guide plate moving unit to offset the offset guide plate and the first sheet contacting member and drive the end fence plate moving unit to offset the end fence plate and the second sheet contacting member; (d) after the step (c), drive the sheet receiving tray lifting unit to lift the sheet receiving tray up by the first amount; (e) after stacking of the sheets at the second sheet stacking position is completed, drive the sheet receiving tray lifting unit to temporarily lift the sheet receiving tray down by a second amount smaller than the first amount; (f) after the step (e), drive the offset guide plate moving unit to offset the offset guide plate and the first sheet contacting member and drive the end fence plate moving unit to offset the end fence plate and the second sheet contacting member; and (g) after the step (f), drive the sheet receiving tray lifting unit to lift the sheet receiving tray up by the second amount.

In the configuration described above, the sheet sorting is performed in such a way that the sheets sequentially discharged from the image forming device are made to fall to the sheet receiving tray and are stacked alternately at the first sheet stacking position set on the sheet receiving tray on the upstream side in the sheet discharging direction and at the second sheet stacking position set to be offset downstream of the first sheet stacking position by the predetermined amount. In the sheet sorting, particularly, in the offsetting of the offset guide plate, the first sheet contacting member, the end fence plate, and the second sheet contacting member which is performed after every time the sheet sorting at the first or second sheet stacking position is completed, the controller sets the amounts of lifting down and up of the sheet receiving tray at the second sheet stacking position to values smaller than the amounts of lifting down and up of the sheet receiving tray at the first sheet stacking position. Accordingly, the time for lifting down and up the sheet receiving tray at the second sheet stacking position can be reduced compared to those at the first sheet stacking position. Moreover, since the total offset moving time is reduced, the productivity of the sheet sorting device can be improved.

An interval between start of a sheet discharge to the first sheet stacking position and a start of sheet discharge to the second sheet stacking position may depend on a difference between the first amount and the second amount.

In the configuration described above, the controller controls the interval between start of sheet discharge to the first sheet stacking position and start of sheet discharge to the second sheet stacking position, according to the difference in the amounts of lifting down and up of the sheet receiving tray at the first and second sheet stacking positions. Accordingly, the sheets can be reliably discharged in a timely manner to the first and second sheet stacking positions set on the sheet receiving tray.

DETAILED DESCRIPTION

Figure 1:
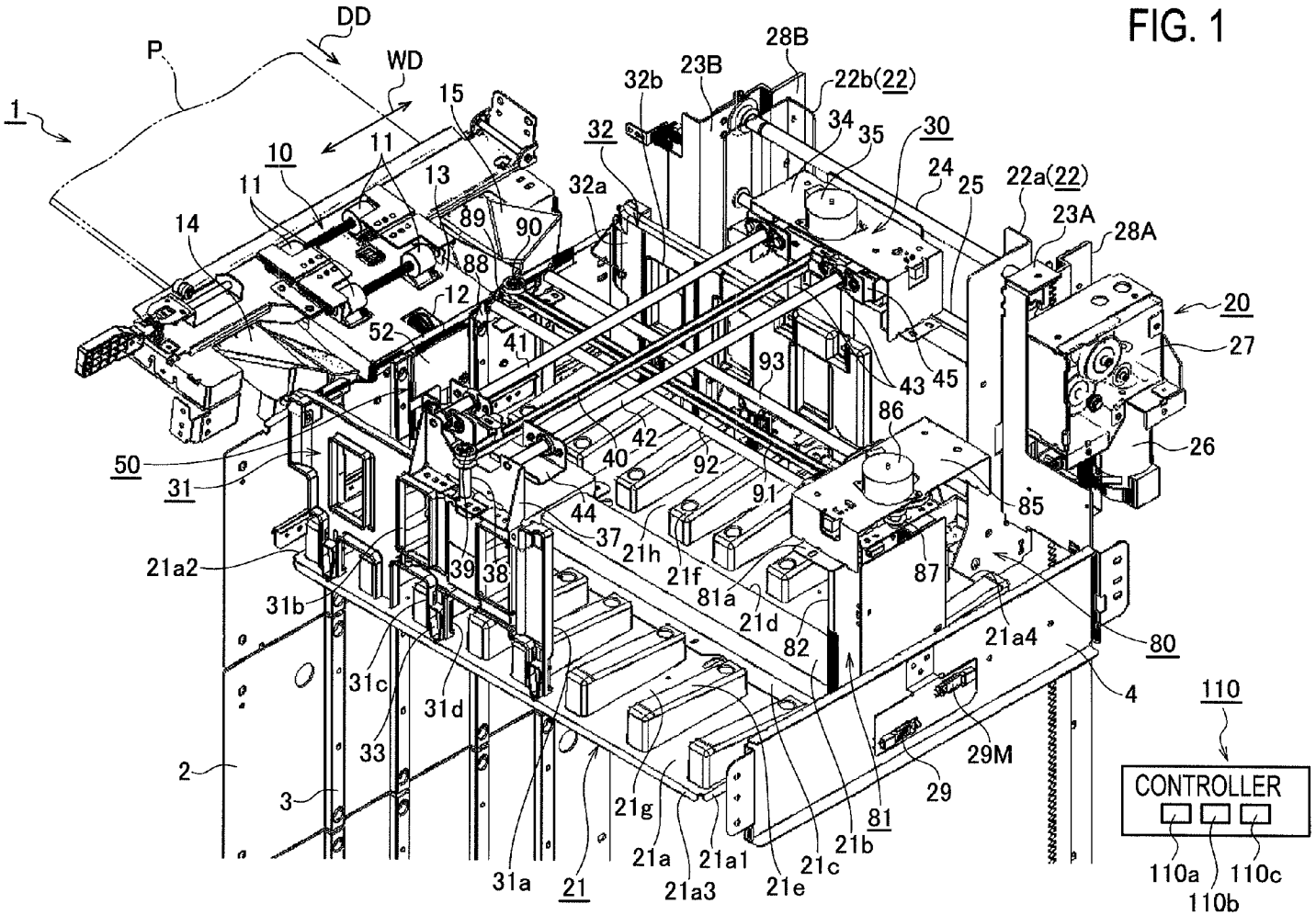
FIG. 1 is a perspective view of a sheet sorting device in an embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

A sheet sorting device of an embodiment of the present invention is described below in detail with reference to FIGS. 1 to 16B.

Figure 2:
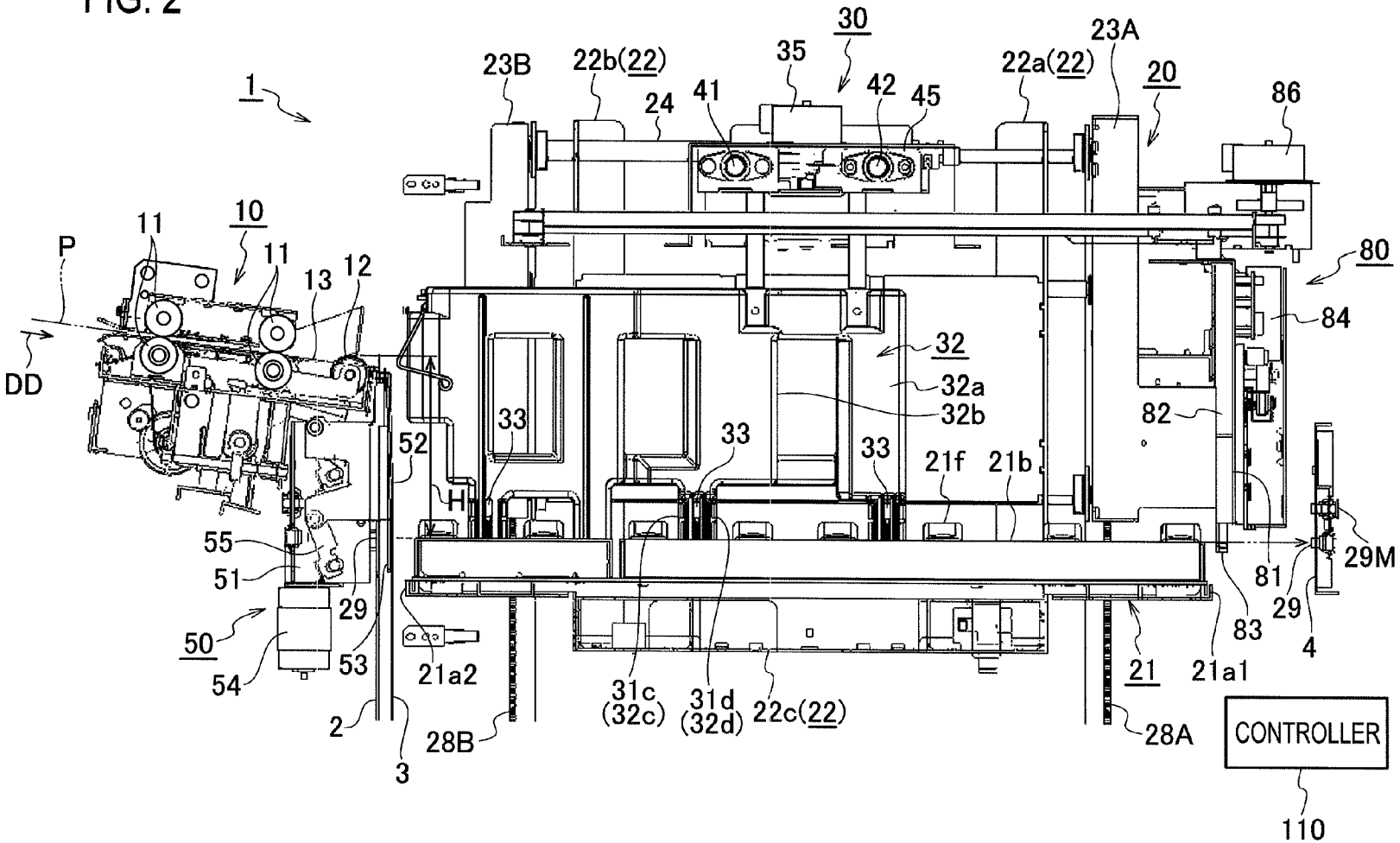
FIG. 2 is a side cross-sectional view of the sheet sorting device in the embodiment of the present invention.

FIG. 1 is a perspective view of an overall configuration of the sheet sorting device 1 of the embodiment of the present invention. FIG. 2 is a side cross-sectional view of the sheet sorting device 1.

The sheet sorting device 1 shown in FIGS. 1 and 2 is applied to an image forming device (not illustrated) capable of forming images on sheets P by using a printing device such as an inkjet printer, a stencil printing device, or a laser printer, a copier and the like and performs printing or copying on many sheets P. The sheet sorting device 1 is installed on a sheet discharge unit side of the image forming device.

The sheet sorting device 1 includes: a sheet discharging unit 10 which sequentially discharges, in a sheet discharging direction DD, the sheets P on which images are formed by the image forming device; a sheet receiving tray 21 on which the sheets P sequentially discharged from the sheet discharging unit 10 are made to fall and are stacked; a sheet receiving tray lifting mechanism 20 in which the sheet receiving tray 21 is attachably and detachably supported on a supporting base portion 22*c* (FIG. 2) of a sheet receiving tray supporter 22 and which lifts up and down the sheet receiving tray 21 in an up-down direction according to a stacked number of the sheets P; and a side fence plate opening-closing mechanism 30 which opens and closes a pair of left and right side fence plates 31, 32 in such a way that the side fence plates 31, 32 are moved, while facing each other, in a sheet width direction WD orthogonal to the sheet discharging direction DD of the sheets P, according to a width of the sheets P, the side fence plates 31, 32 configured to align left and right ends, in a width direction, of the sheets P stacked on the sheet receiving tray 21.

Figure 3:
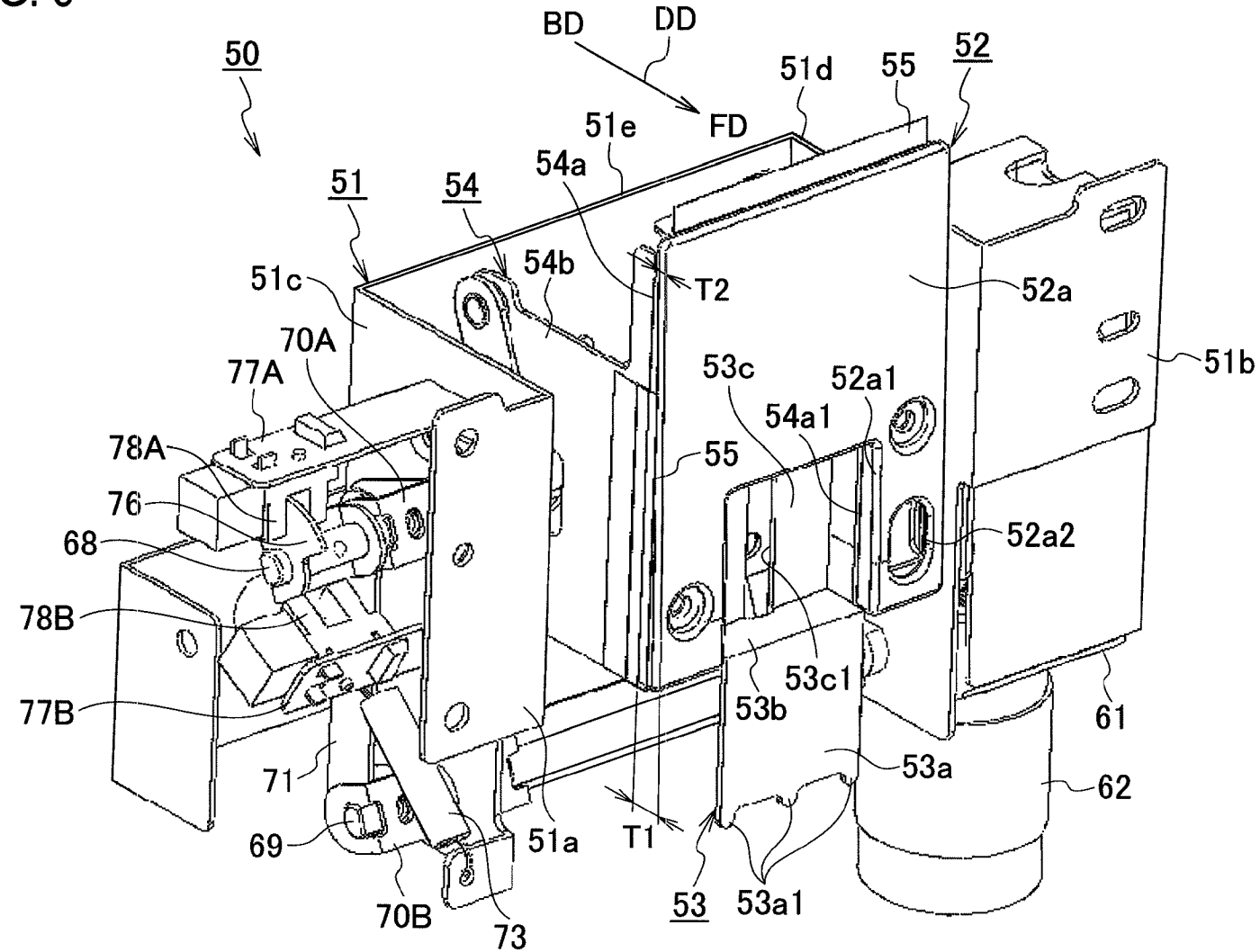
FIG. 3 is an enlarged perspective view of an offset guide plate moving mechanism shown in FIGS. 1 and 2.

The sheet sorting device 1 includes an offset guide plate moving mechanism 50. The offset guide plate moving mechanism 50 moves an offset guide plate 52 to a lower front side or to an upper rear side in the sheet discharging direction DD by a predetermined offset amount for each sorted stack of sheets to offset rear ends, in the sheet discharging direction DD, of the sheets P stacked on the sheet receiving tray 21 by using the offset guide plate 52 when sorting sheets, the offset guide plate 52 provided on an upstream side in the sheet discharging direction DD of the sheets P and above the sheet receiving tray 21 to extend downward from the a first bracket 51 (FIGS. 2 and 3). Moreover, in the offset guide plate moving mechanism 50, a first sheet contacting member 53 (FIGS. 2 and 3) attached to a lower portion of the offset guide plate 52 is moved downward in the gravity direction by its own weight. Note that reference signs FD and BD in the drawings respectively denote a front side and a rear side.

The sheet sorting device 1 includes an end fence plate moving mechanism 80. The end fence plate moving mechanism 80 moves an end fence plate 82 to the front side or the rear side in the sheet discharging direction DD by a predetermined offset amount for each sorted stack of sheets to offset front ends, in the sheet discharging direction DD, of the sheets P stacked on the sheet receiving tray 21 by using the end fence plate 82 when sorting sheets, the end fence plate 82 provided above the sheet receiving tray 21 and on a downstream side in the sheet discharging direction DD of the sheet P to be spaced away from the offset guide plate 52 at an interval equal to a length of the sheets P and to extend downward from a second bracket 81. Moreover, in the end fence plate moving mechanism 80, second sheet contacting members 83 (FIG. 2 and FIGS. 9 to 11(*b*)) attached to a lower portion of the end fence plate 82 are moved downward in the gravity direction by their own weight.

In the sheet sorting device 1, a controller 110 configured to control the entire device is installed at an appropriate position in the device 1.

As shown in FIG. 1, the controller 110 includes a CPU 110*a*, a ROM 110*b*, and a RAM 110*c*.

The CPU 110*a* in the controller 110 controls the sheet discharging unit 10, the sheet receiving tray lifting mechanism 20, the side fence plate opening-closing mechanism 30, the offset guide plate moving mechanism 50, and the end fence plate moving mechanism 80.

The ROM 110*b* in the controller 110 stores an operation program of the sheet sorting device 1 and the like. Moreover, the RAM 110*c* in the controller 110 temporarily stores various pieces of information which can be changed in the sheet sorting device 1. The various pieces of information which can be changed includes, for example, information on the size of the sheets P detected in the not-illustrated image forming device and paper quality (thin paper, ordinary paper, thick paper) of the sheets P set by the user in the image forming device.

Since the sheet receiving tray 21 is lifted up and down in the up-down direction by the sheet receiving tray lifting mechanism 20 in a substantially horizontal posture, the sheets P stacked on the sheet receiving tray 21 are surrounded by a total of four plates including: the pair of left and right side fence plates 31, 32 aligning left and right side ends in a sheet width direction WD; the offset guide plate 52 (or below-mentioned sheet guide fence plates 3 used in a normal mode) provided on the upstream side in the sheet discharging direction DD of the sheets P and aligning the rear ends of the sheets P in the sheet discharging direction DD; and the end fence plate 82 provided on the downstream side in the sheet discharging direction DD of the sheets P and aligning the front ends of the sheets P in the sheet discharging direction DD, and the plates 31, 32, 52, 3, and 82 are provided separately from the sheet receiving tray 21.

<Specific Configurations of Respective Units in Sheet Sorting Device 1>

Here, specific configurations of the units in the sheet sorting device 1 are described one by one.

First, as shown in FIG. 1, the sheet discharging unit 10 is attached to an upper portion of a rear plate 2 of the sheet sorting device 1. In the sheet discharging unit 10, a discharging roller 12 located near a sheet discharging position and two sheet transporting roller sets 11, 11 each including upper and lower paired rollers and left and right paired rollers which transport the sheets P discharged from the not-illustrated image forming device are installed along a sheet transporting guide plate 13.

A pair of left and right sheet stiffness supporting wing members 14, 15 are installed on the left and right sides of the sheet transporting guide plate 13 to be inclined in a left-right symmetric manner in such a way that the heights thereof become gradually larger from the inner side toward the outer side in the sheet width direction WD. The amount of stiffness support to the sheets P is variably set by changing the heights of inclined surfaces of the sheet stiffness supporting wing members 14, 15 in the left-right symmetric manner, according to the stiffness of the type of the sheets P.

The multiple sheet guide fence plates 3 are attached to the rear plate 2 of the sheet sorting device 1 at intervals, in a left-right symmetric manner about a center portion of the rear plate 2 in the sheet width direction WD. The sheet guide fence plates 3 are configured to align the rear ends of the sheets P stacked on the sheet receiving tray 21.

Although the sheet discharging unit 10 is installed in the sheet sorting device 1 in the embodiment to secure an accurate discharging position of the sheets P, the present invention is not limited to this configuration. For example, there may be employed a configuration in which a constitutional member which is substantially the same as the sheet discharging unit 10 is installed in the image forming device and the sheets P are sequentially discharged from the image forming device.

Next, in the sheet receiving tray lifting mechanism 20, the sheet receiving tray 21 is disposed substantially horizontally between the rear plate 2 of the sheet sorting device 1 and a front plate 4 facing the rear plate 2 at an interval.

In the sheet receiving tray 21, a bottom plate portion 21*a* is formed to have an outer dimension large enough to stack the sheets P of, for example, A3 size as a maximum size. The sheet receiving tray 21 is formed in a rectangular plate shape and is surrounded by a front face 21*a*2 located on the downstream side in the sheet discharging direction DD of sheets P, a rear face 21*a*2 located on the upstream side in the sheet discharging direction DD of the sheets P, and left and right side faces 21*a*3, 21*a*4 in the sheet width direction WD orthogonal to the sheet discharging direction DD of the sheets P.

In the sheet receiving tray 21, an upper face plate portion 21*b* is formed on the bottom plate portion 21*a* in a substantially center portion thereof between the left and right side faces 21*a*3, 21*a*4 to protrude to a height slightly higher than that of the bottom plate portion 21*a* and to extend in the sheet discharging direction DD and have a predetermined width in the sheet width direction WD.

On the bottom plate portion 21*a* of the sheet receiving tray 21, first gap portions 21*c*, 21*d* are each set to have a predetermined width and extend along the upper face plate portion 21*b* on left and right sides thereof. Moreover, multiple pairs of left and right inclined surface portions 21*e*, 21*f* are formed on the bottom plate portion 21*a* of the sheet receiving tray 21 to protrude in a left-right symmetric manner so that the sheets P are supported to form a proper shape through the first gap portions 21*c*, 21*d* and have an appropriate shape.

Here, each adjacent two pairs of inclined surface portions 21*e*, 21*f* are spaced away from each other by corresponding second gap portions 21*g*, 21*h* which are set in left and right portions of the bottom plate portion 21*a* to have a predetermined width in the sheet discharging direction DD. Moreover, the inclined surface portions 21*e*, 21*f* are formed to become gradually higher toward the left and right side faces 21*a*3, 21*a*4.

Many, about 4000, sheets P of any one type of the A3 size, an A4 size, and a postal card size can be stacked on the upper face plate portion 21*b* and the pairs of inclined surface portions 21*e*, 21*f* of the sheet receiving tray 21. For example, amounts of lifting up and down of the sheet receiving tray 21 is each set to about 400 mm to 500 mm, for example.

The sheet receiving tray supporter 22 by which the sheet receiving tray 21 is attachably and detachably supported is provided to extend from the right face 21*a*4 to the left face 21*a*3 of the bottom plate portion 21*a* of the sheet receiving tray 21.

In the sheet receiving tray supporter 22, a pair of L-shaped plate portions 22*a*, 22*b* are attached to the right face 21*a*4 of the bottom plate portion 21*a* in a vertical posture in a front-rear symmetric manner at an interval in the front-rear direction. Moreover, in the sheet receiving tray supporter 22, a supporting base portion 22*c* (FIG. 2) which is perpendicularly and continuously connected to lower end portions of the pair of L-shaped plate portions 22*a*, 22*b* and by which the sheet receiving tray 21 is attachably and detachably supported, is integrally formed to horizontally extend toward the left face 21*a*3 of the bottom plate portion 21*a*.

Here, as shown in FIG. 2, the supporting base portion 22*c* of the sheet receiving tray supporter 22 is formed such that the length in the sheet discharging direction DD is shorter than that of the bottom plate portion 21*a* of the sheet receiving tray 21 but the dimension in the sheet width direction WD is substantially the same as that of the bottom plate portion 21*a* of the sheet receiving tray 21.

Brackets 23A, 23B are provided respectively on outer sides of front and rear portions of the pair of L-shaped plate portions 22*a*, 22*b* of the sheet receiving tray supporter 22. The brackets 23A, 23B are provided in a vertical posture similar to the pair of L-shaped plate portions 22*a*, 22*b* of the sheet receiving tray supporter 22.

The front and rear brackets 23A, 23B are connected to each other by connecting bars 24 (one is not illustrated) provided on the upper side and the lower side which passes through the L-shaped plate portions 22*a*, 22*b* of the sheet receiving tray supporter 22. Moreover, in the front and rear brackets 23A, 23B, a drive shaft 25 is rotatably supported about its axis between the upper and lower connecting bars 24 in parallel with the connecting bars 24.

A DC motor 26 and a gear box 27 connected to the DC motor 26 are attached to the front bracket 23A. A final gear (not illustrated) in the gear box 27 meshes with a drive gear (not illustrated) attached to a front end portion of the drive shaft 25 and another drive gear (not illustrated) is also attached to a rear end portion of the drive shaft 25.

Long front and rear racks 28A, 28B are provided on near side portions of the front and rear brackets 23A, 23B to extend downward and the drive gears (not illustrated) attached to the front and rear end portions of the drive shaft 25 mesh with the front and rear racks 28A, 28B. The sheet receiving tray supporter 22 can thereby travel integrally with the front and rear brackets 23A, 23B in the up-down direction by drive force of the DC motor 26.

When the drive gears (not illustrated) attached to the front and rear end portions of the drive shaft 25 are rotated in a normal direction or a reverse direction along the front and rear racks 28A, 28B by activating the DC motor 26, the sheet receiving tray 21 attachably and detachably supported by the supporting base portion 22*c* of the sheet receiving tray supporter 22 is lifted up or down in the up-down direction.

As shown in FIG. 2, a sheet height position detecting optical sensor 29 is attached to the rear plate 2 of the sheet sorting device 1 and to the front plate 4 facing the rear plate 2 at an interval. The sheet height position detecting optical sensor 29 has a light emitting portion and a light receiving portion facing each other.

The sheet height position detecting optical sensor 29 detects the height of the upper face plate portion 21*b* of the sheet receiving tray 21 on which no sheets P are stacked or the height position of the top sheet P among the sheets P stacked on the upper face plate portion 21*b* of the sheet receiving tray 21.

Accordingly, a sheet falling height H (FIGS. 2 and 15) can be controlled to be substantially constant when the sheets P sequentially discharged from the sheet discharging unit 10 (or the image forming device) fall on the sheet receiving tray 21, the sheet falling height H set between the discharging position from which the sheets P are discharged and one of: the upper face plate portion 21*b* of the sheet receiving tray 21 on which no sheets P are stacked; and the top sheet P stacked on the upper face plate portion 21*b* of the sheet receiving tray 21.

Specifically, the controller 110 lifts the sheet receiving tray 21 up or down by using the DC motor 26 to the sheet height position according to the stacked number of the sheets P, on the basis of a detection result from the sheet height position detecting optical sensor 29. The sheets P discharged from the sheet discharging unit 10 thereby fall to a position at the substantially constant sheet falling height H and are orderly stacked on the sheet receiving tray 21 while maintaining a normal posture.

Figure 4:
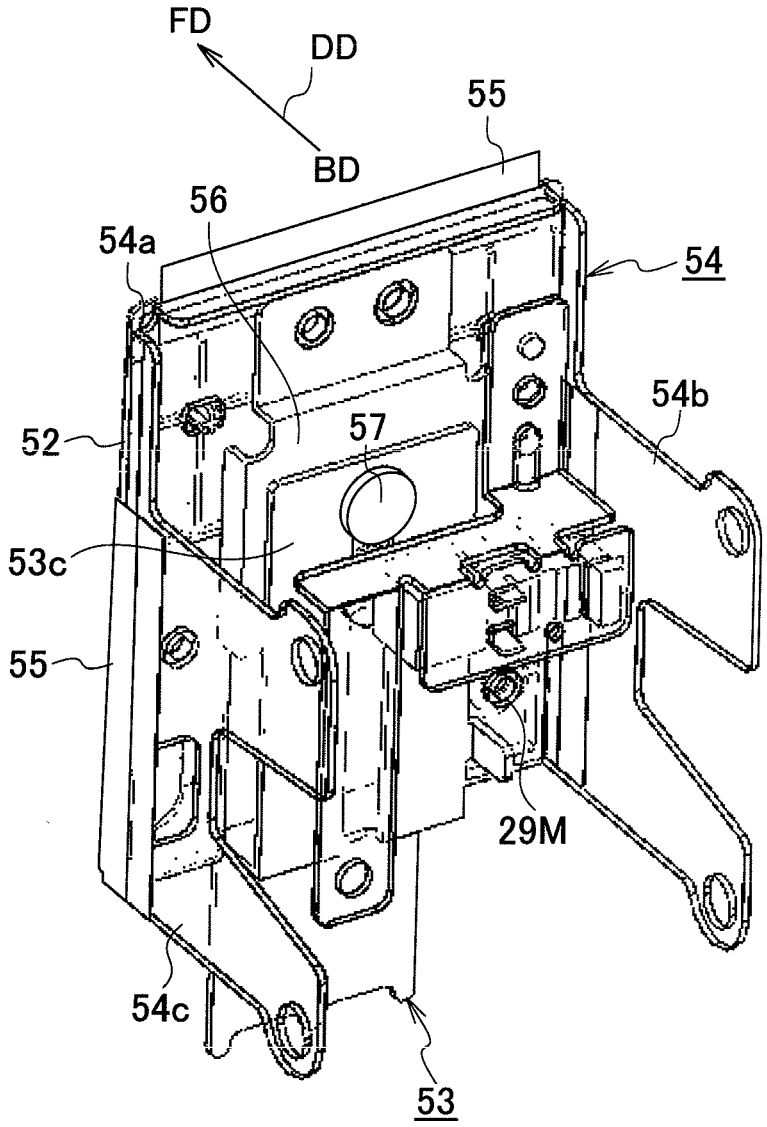
FIG. 4 is a perspective view of an offset guide plate attached to a movable bracket and a first sheet contacting member in the offset guide plate moving mechanism, as viewed from a rear side in a sheet discharging direction.

One sheet lean detecting optical sensor 29M is attached to the front plate 4, close to the sheet height position detecting sensor 29 but at a position slightly thereabove. Another sheet lean detecting optical sensor 29M is attached to a front face of the offset guide plate 52 as shown in FIG. 4 to face a through hole 52*a*2 of the offset guide plate 52 shown in FIG. 3 to be described later.

The sheet lean detecting optical sensors 29M have a function of detecting a state where the sheets P stacked on the sheet receiving tray 21 lean (rest) on: the multiple sheet guide fence plates 3 attached to the rear plate 2; the pair of left and right side fence plates 31, 32; the offset guide plate 52; and the like. The controller 110 detects sheet stacking failure on the sheet receiving tray 21 on the basis of a detection result from the sheet lean detecting optical sensors 29M.

A sheet fully-loaded state detecting optical sensor (not illustrated) for detecting a fully-loaded state of the sheets P on the sheet receiving tray 21 is installed in a lower portion of the front and rear racks 28A, 28B.

Next, in the side fence plate opening-closing mechanism 30, the pair of left and right side fence plates 31, 32 are disposed in a vertical posture above the left and right portions of the sheet receiving tray 21, in parallel with the sheet discharging direction DD of the sheets P, to face each other at an interval.

In the pair of left and right side fence plates 31, 32, sheet holding surfaces 31*a*, 32*a* which are formed in a rectangular plate shape elongated in the sheet discharging direction DD of the sheets P and which are configured to hold the sheets P, are formed flat to face each other inwardly. Moreover, multiple holes 31*b*, 32*b* for letting out air between the sheets are formed in intermediate portions of the pair of left and right side fence plates 31, 32 to penetrate the side fence plates 31, 32. The sheets P discharged from the sheet discharging unit 10 can thereby fall on the sheet receiving tray 21 without being affected by air resistance.

Multiple pairs of guiding bent pieces (31*c*, 31*d*), (32*c*, 32*d*) are formed in lower portions of the pair of left and right side fence plates 31, 32 to protrude downward. Reference numerals 32*c*, 32*d* of FIG. 2 denote one pair of guiding bent pieces of the side fence plate 32.

The multiple pairs of guiding bent pieces (31*c*, 31*d*), (32*c*, 32*d*) enter the second gap portions 21*g*, 21*h* set in the left and right portions of the bottom plate portion 21*a* of the sheet receiving tray 21 and are positioned with respect to the sheet discharging direction DD. An extended fence member 33 is supported between each pair of guiding bent pieces (31*c*, 31*d*), (32*c*, 32*d*) to be movable upward and downward and tunable in a sheet take-out direction (truck take-out direction) RD.

The extended fence member 33 has a function of extending the lower portions of the pair of left and right side fence plates 31, 32 to serve for a state where many sheets P are stacked on the sheet receiving tray 21 and a function of facilitating the take-out of the sheets P stacked on the sheet receiving tray 21 from the device 1.

An opening-closing mechanism which moves the pair of left and right side fence plates 31, 32 in the sheet width direction WD in a facing manner to open and close the side fence plates 31, 32 according to the width size of the sheets P is attached to a back surface of a top plate (not illustrated) covering an upper portion of the sheet sorting device 1 as an example of a supporting member provided above the sheet receiving tray 21.

Specifically, a first geared pulse motor 35 is attached to the back surface of the not-illustrated top plate via a first motor bracket 34 supported by the back surface, so as to be rotatable in normal and reverse directions.

The rotation of the first geared pulse motor 35 is transmitted to a first timing pulley on the right side and a first timing belt 40 is passed around the first timing pulley and a second timing pulley 39 on the left side. The second timing pulley 39 faces the first timing pulley at an interval and is attached at its axis to a shaft 38 on a bracket 37 fixedly installed above the left side fence plate 31.

Between the first timing pulley and the second timing pulley 39, two first and second guide shafts 41, 42 are supported on the front and rear sides of the first timing belt 40 with the first timing belt 40 interposed therebetween, in parallel with the sheet width direction WD.

A pair of left and right sliders 44, 45 are connected to upper portions of the pair of side fence plates 31, 32 via two shafts 43. The pair of left and right sliders 44, 45 are fitted to be slidable in the sheet width direction WD along the two first and second guide shafts 41, 42. The left slider 44 is connected to a rear side of the first timing belt 40 while the right slider 45 is connected to a front side of the first timing belt 40. The left and right sliders 44, 45 can thereby be moved closer to each other or further away from each other while facing each other.

Accordingly, when the first geared pulse motor 35 is activated and the first timing belt 40 is turned in the normal direction, the pair of left and right side fence plates 31, 32 are moved inward (or outward). Meanwhile, when the first timing belt 40 is turned in the reverse direction, the pair of left and right side fence plates 31, 32 are moved outward (or inward). The pair of left and right side fence plates 31, 32 can thereby align the left and right side ends of the sheets P in the sheet width direction WD, according to the width of the sheets P.

The offset guide plate moving mechanism 50 is attached as a unit directly below the sheet discharging unit 10 to perform sheet sorting after the sheets P sequentially discharged from the sheet discharging unit 10 have fallen. The sheet sorting process shall be described later.

The offset guide plate moving mechanism 50 is described specifically by using FIGS. 3 to 8(*b*).

FIGS. 3 to 8(*b*) are enlarged views for explaining the offset guide plate moving mechanism 50.

In the offset guide plate moving mechanism 50 shown in an enlarged manner in FIG. 3, in the first bracket 51 which is a base of the offset guide plate moving mechanism 50, there are formed, by bending a metal plate material, left and right front face plates 51*a*, 51*b* spaced away from each other on the left and right sides and configured to be attached to the rear plate 2 (FIGS. 1 and 2) in a vertical posture, left and right side face plates 51*c*, 51*d* continuously connected to the left and right front face plates 51*a*, 51*b* and extending rearward in the sheet discharging direction DD, and a rear face plate 51*e* connecting the left and right side face plates 51*c*, 51*d* to each other.

A movable bracket 54 to which the offset guide plate 52 and the first sheet contacting member 53 are attached is provided in a portion formed in a recessed shape by the left and right side face plates 51*c*, 51*d* and the rear face plate 51*e* of the first bracket 51, in such a way as to be movable to a lower front side or to an upper rear side with respect to the sheet discharging direction DD by using a link mechanism connected to a motor 62 which is described below.

In the movable bracket 54, there are formed, by bending a metal plate, a front face plate 54*a* and left and right side face plates 54*b*, 54*c* (FIGS. 4 and 6) continuously connected to left and right portions of the front face plate 54*a* and extending rearward, the plate portions 54*a*, 54*b*, 54*c* formed by bending a metal plate material.

The offset guide plate 52 is integrally and fixedly attached to a front face of the front face plate 54*a* of the movable bracket 54 with a sheet holding surface 52*a* for holding the sheets P facing forward. The offset guide plate 52 is formed such that the thickness T1 of a lower portion thereof is thinner than the thickness T2 of an upper portion thereof. Accordingly, the sheet holding surface 52*a* is formed in a tapered surface shape.

By causing an inclination angle of the sheet holding surface 52*a* of the offset guide plate 52 to be inclined at, for example, about 3° with respect to a vertical line, the tapered surface shape can prevent the rear ends of the sheets P from leaning on the sheet holding surface 52*a* when the sheets P bounce off the end fence plate 82 in the sheet sorting to be described later.

Antistatic brushes 55 for removing electricity from the sheets P are fixedly attached to an upper portion of the offset guide plate 52 and lower front portions of the left and right side face plates 54*b*, 54*c* of the movable bracket 54.

In a lower center portion of the front face plate 54*a* of the movable bracket 54 and a lower center portion of the sheet holding surface 52*a* of the offset guide plate 52, a recessed portion 54*a*1 and a recessed portion 52*a*1 are formed by being cut out in recessed shapes to overlap each other and to extend downward. In the recessed portion 54*a*1 and the recessed portion 52*a*1, the first sheet contacting member 53 is attached to be movable upward and downward with a sheet holding surface 53*a* for holding the sheets P and the sheet holding surface 52*a* of the offset guide plate 52 aligned with each other.

The first sheet contacting member 53 is formed as follows. The sheet holding surface 53*a* is formed flat in a lower portion by using a metal plate material, a connecting portion 53*b* is formed to be continuously connected to an upper portion of the sheet holding surface 53*a* by being perpendicularly bent rearward with a small depth, a slide plate portion 53*c* is formed to be elongated and to be continuously connected to the connecting portion 53*b* by being perpendicularly bent upward, and a vertical hole 53*c*1 is formed in the slide plate portion 53*c*.

Semi-circular protruding portions 53*a*1 protrude downward from three positions in left, right, and center sections of a lower end portion of the sheet holding surface 53*a* of the first sheet contacting member 53. These semi-circular protruding portions 53*a*1 at three positions are configured to gently come into contact with the top sheet P stacked on the sheet receiving tray 21 in the sheet sorting to be described later.

The connecting portion 53*b* of the first sheet contacting member 53 extends into the recessed portion 54*a*1 of the movable bracket 54 and the recessed portion 52*a*1 of the offset guide plate 52, and the slide plate portion 53*c* extends to a back surface side of the movable bracket 54 and is slidably attached.

Here, as shown in an enlarged manner in FIG. 4, the slide plate portion 53*c* of the first sheet contacting member 53 is guided by a guide member 56 having a step and attached to the back surface of the front face plate 54*a* of the movable bracket 54 and by a guide pin 57 fitted to the vertical hole 53*c*1 (FIG. 3) formed in the slide plate portion 53*c*, in such a way as to be movable in the up-down direction by about 20 mm. The first sheet contacting member 53 is lowered by the gravity.

Figure 5:
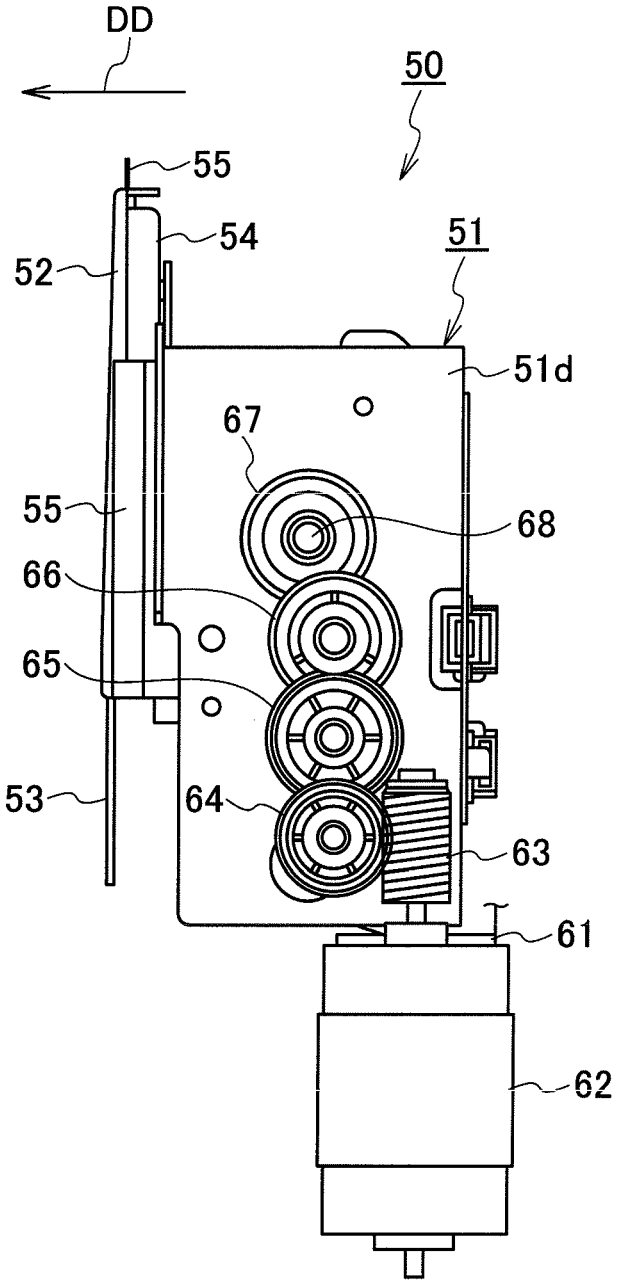
FIG. 5 is a side view showing a drive source for moving the offset guide plate in the offset guide plate moving mechanism.

As shown in FIG. 5, a motor bracket 61 is attached outside the right side face portion 51*d* of the first bracket 51, so that the movable bracket 54 to which the offset guide plate 52 and the first sheet contacting member 53 are attached can be moved in the up-down direction and in the front-rear direction with respect to the sheet discharging direction DD.

A worm gear 63 is fixedly attached to a shaft of the motor 62 attached to the motor bracket 61. The rotation of the worm gear 63 is sequentially transmitted to gear trains 64 to 67 supported about their axes by the right side face portion 51*d* of the first bracket 51, and the rotation of the motor 62 is thus reduced by the gear trains 64 to 67.

The final gear 67 in the gear trains 64 to 67 is fixedly attached to one end of an upper shaft 68 turnably supported about its axis in an upper rear portion of the first bracket 51 between the left and right side face plates (51*c*), 51*d*.

Figure 6:
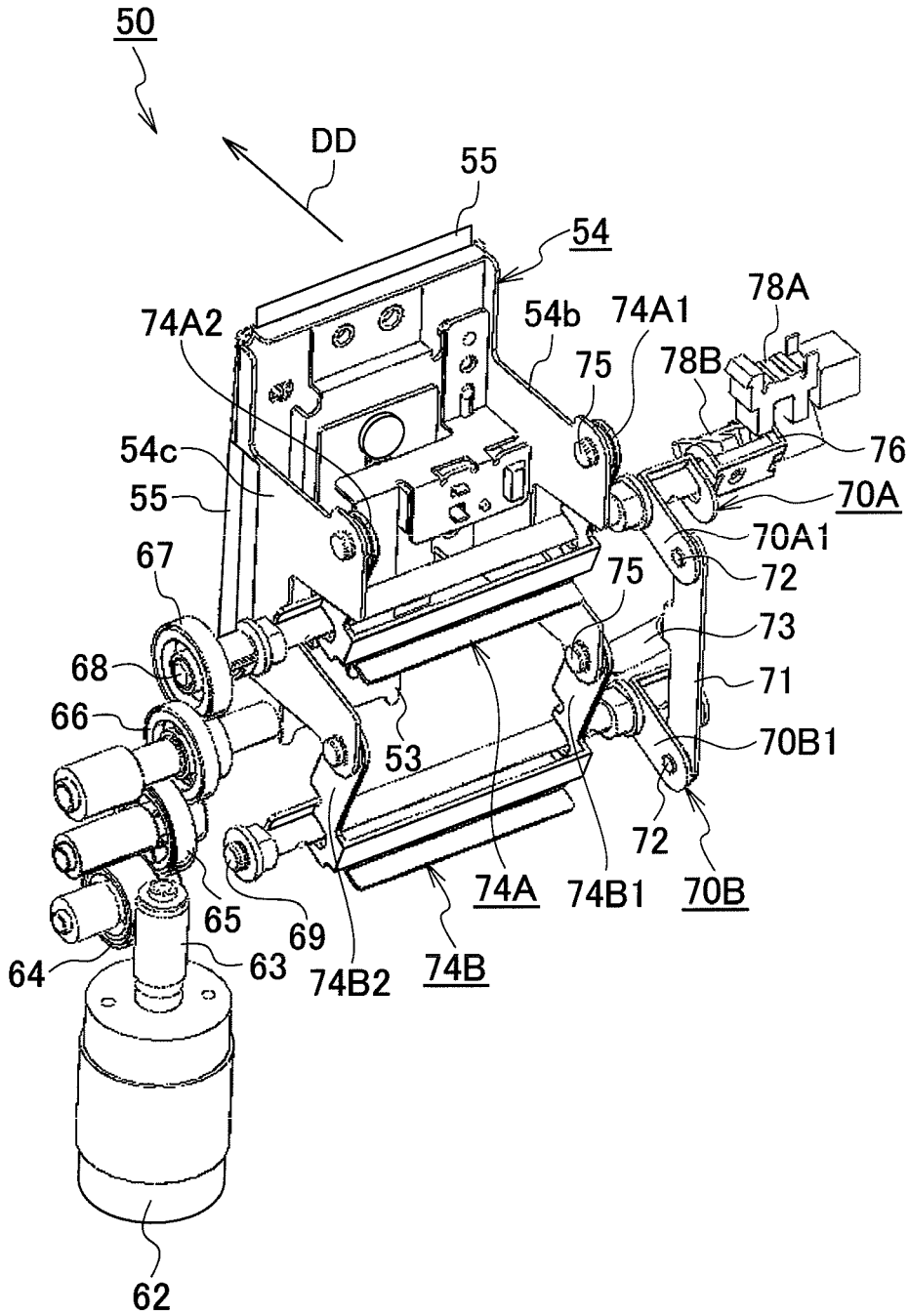
FIG. 6 is a perspective view showing the drive source and a link mechanism for moving the offset guide plate in the offset guide plate moving mechanism.
Figure 7:
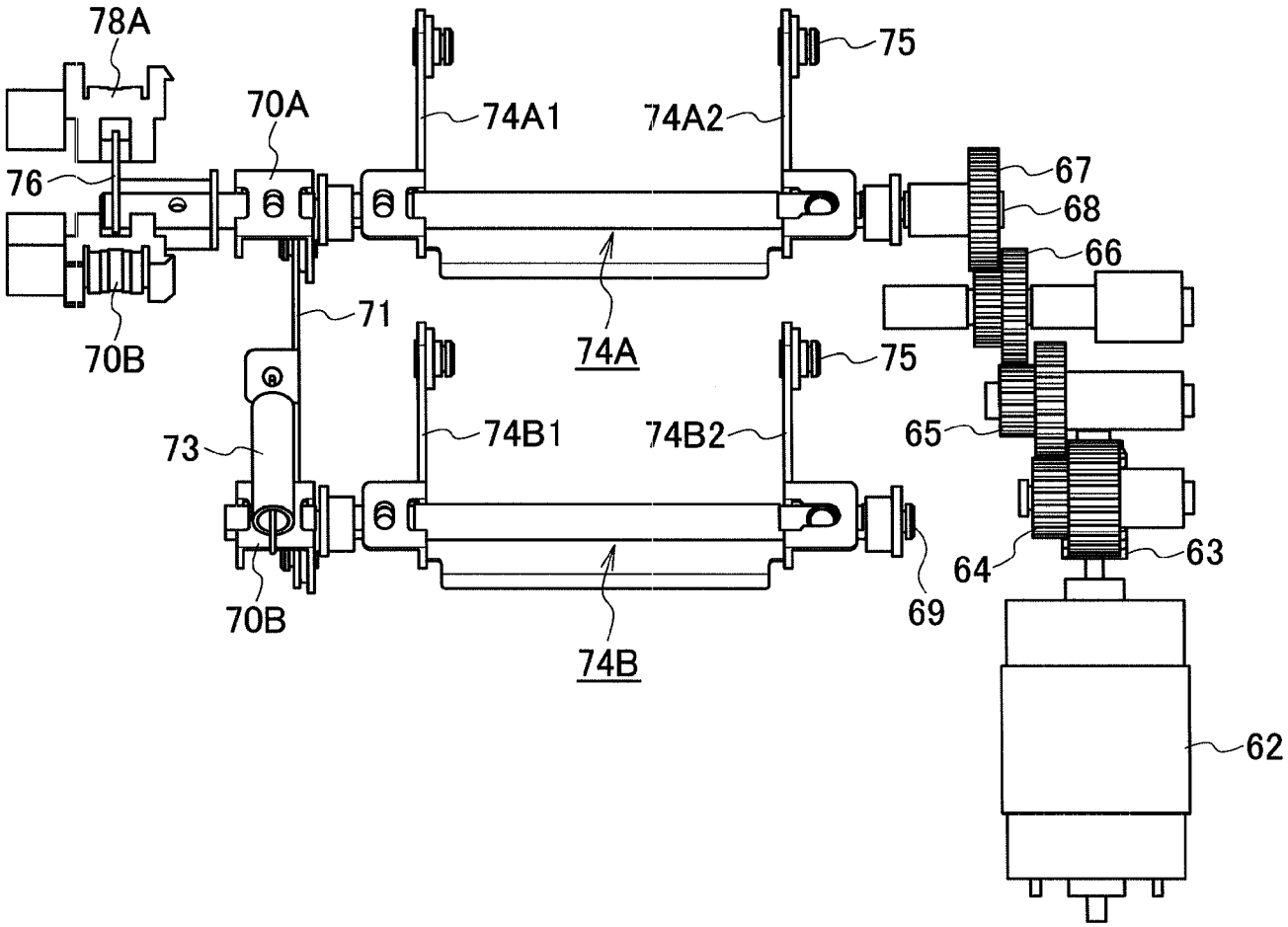
FIG. 7 is a rear view showing the drive source and the link mechanism for moving the offset guide plate in the offset guide plate moving mechanism.

As shown in an enlarged manner in FIGS. 3, 6, and 7, in a lower rear portion of the first bracket 51 between the left and right side face plates 51*c*, 51*d*, a lower shaft 69 is turnably supported about its axis, in parallel with the upper shaft 68 described above.

As shown in FIG. 3, left end portions of the upper shaft 68 and the lower shaft 69 extend outside the left side face plate 51*c* of the first bracket 51 which is located outside the left side face plate 54*b* of the movable bracket 54.

In the left end portions of the upper shaft 68 and the lower shaft 69, a pair of upper and lower first link members 70A, 70B each formed by bending a metal plate material in a square-U shape having a small width are fixedly attached to D-cut surfaces of the shafts 68, 69 by using not-illustrated screw to be provided on the upper and lower sides in parallel with each other. A linking plate 71 is turnably supported between arm portions 70A1, 70B1 of the pair of upper and lower first link members 70A, 70B via pins 72.

One end of a tension spring 73 is hooked to an intermediate portion of the linking plate 71. The other end of the tension spring 73 is hooked to a lower front end of the left side face plate 51*c* of the first bracket 51. The tension spring 73 urges the linking plate 71 in an oblique front lower direction.

As shown in FIGS. 6 and 7, in intermediate end portions of the upper shaft 68 and the lower shaft 69, a pair of upper and lower second link members 74A, 74B each formed by bending a metal plate material in a square-U shape having a large width are provided on the upper and lower sides in parallel with each other with left and right ends fixedly attached to D-cut surfaces of the shafts 68, 69 by using not-illustrated screws.

The left and right arms portions 74A1, 74A2; 74B1, 74B2 facing each other at intervals and provided in left and right portions of the pair of upper and lower second link members 74A, 74B are turnably supported by upper and lower rear portions of the left and right side face plates 54*b*, 54*c* of the movable bracket 54 via pins 75.

As shown in FIG. 3, the left end portion of the upper shaft 68 extends beyond the left end portion of the lower shaft 69. A sector-shaped sensor detection plate 76 is fixedly attached to this extended portion outside the upper first link member 70A.

The sector-shaped sensor detection plate 76 advances into and retreats from a pair of optical sensors 78A, 78B fixedly attached to a pair of sensor supporting plates 77A, 77B attached outside the left side face plate 51*c* of the first bracket 51 at a predetermined interval. The pair of optical sensors 78A, 78B can detect that the offset guide plate 52 has reached positions corresponding to first and second sheet stacking positions in the sheet sorting to be described later, with the rotation of the upper shaft 68.

Figure 8:
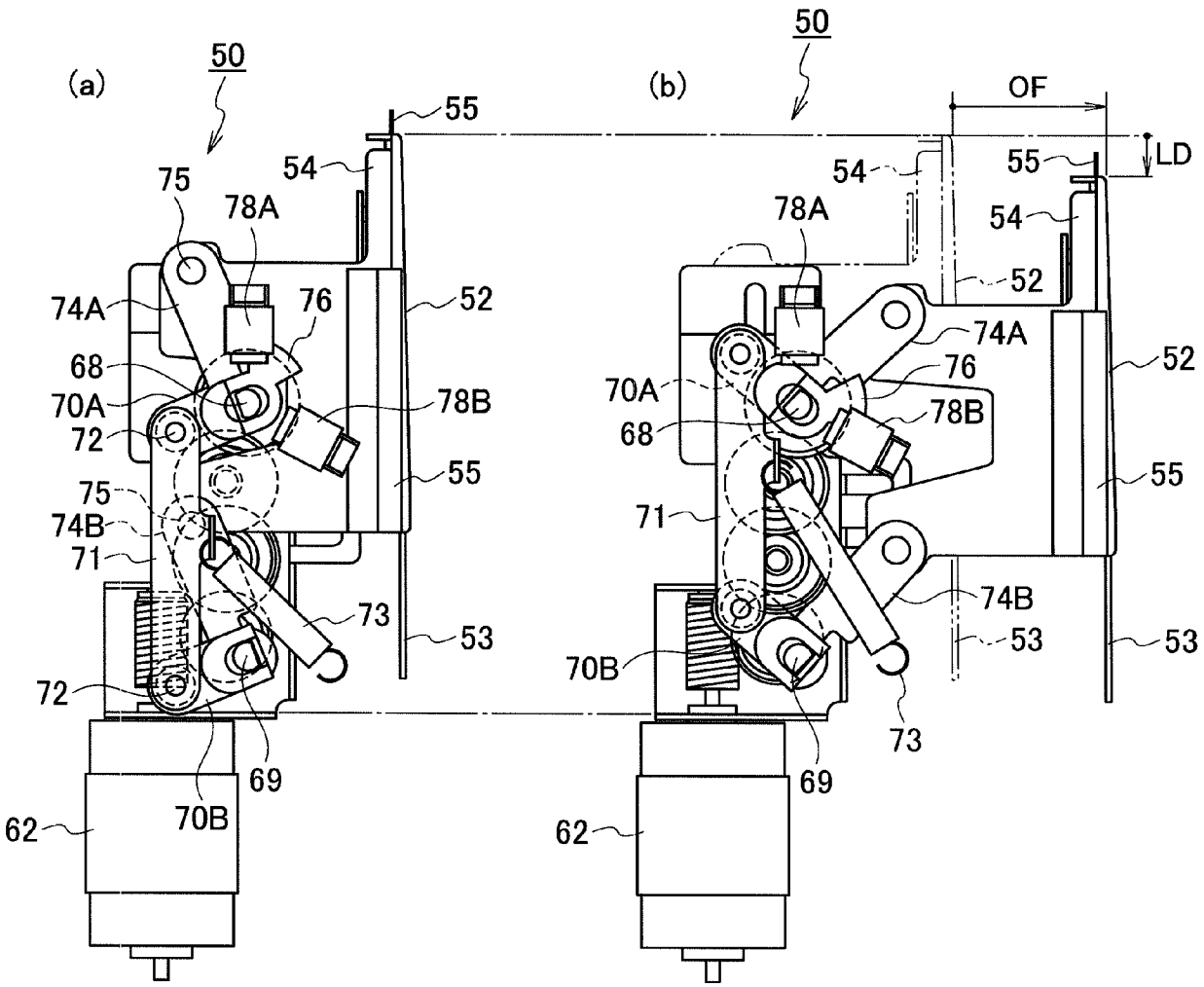
FIGS. 8(*a*) and 8(*b*) are views for explaining an operation of the offset guide plate moving mechanism.

In a case where the offset guide plate moving mechanism 50 is configured as described above, when the upper optical sensor 74A is blocked by the sector-shaped sensor detection plate 76 fixedly attached to the upper shaft 68 rotated by drive force of the motor 62 as shown in FIG. 8(*a*), the offset guide plate 52 attached to the movable bracket 54 is stopped at a waiting position set near the rear plate 2 of the device 1.

Here, the pair of upper and lower first link members 70A, 70B fixedly attached to the upper and lower shafts 68, 69 are connected to each other by the linking plate 71 to be provided on the upper and lower sides in parallel with each other while the pair of upper and lower second link members 74A, 74B fixedly attached to the upper and lower shafts 68, 69 are connected to the movable bracket 54 to be provided on the upper and lower sides in parallel with each other. Accordingly, when the upper shaft 68 reaches a turning angle corresponding to the waiting position, the offset guide plate 52 attached to the movable bracket 54 serves for the first sheet stacking position set on the sheet receiving tray 21 in the sheet sorting to be described later.

Meanwhile, as shown in FIG. 8(*b*), when the upper shaft is turned in the clockwise direction from the waiting position of FIG. 8(*a*) by activating the motor 62 and the lateral optical sensor 78B is blocked by the sector-shaped sensor detection plate 76 fixedly attached to the upper shaft 68, the offset guide plate 52 attached to the movable bracket 54 reaches an offset position located on a lower front side of the waiting position by the operation of the link mechanism (70A, 70B, 71, 74A, 74B) and stops. The offset guide plate 52 thus serves for the second sheet stacking position set on the sheet receiving tray 21 in the sheet sorting to be described later.

In this case, an offset amount OF of the offset guide plate 52 to the front side is set to be, for example, about +30 mm while a lowered amount LD of the offset guide plate 52 to the lower side is set to be, for example, about 5 mm.

By rotating the motor 62 in the normal and reverse directions, the offset guide plate 52 is moved repeatedly and alternately between the waiting position set on the upstream side in the sheet discharging direction DD and the offset position set on the downstream side in the sheet discharging direction DD. The offset guide plate 52 can thus move, for example, about 30 mm in the front-rear direction and move, for example, about 5 mm in the up-down direction.

Accordingly, the offset guide plate 52 and the first sheet contacting member 53 can be integrally moved to the lower front side or the upper rear side by the predetermined offset amount for each sorted stack of sheets.

As shown in FIGS. 1 and 2, the end fence plate moving mechanism 80 is provided as a unit on a front face 21*a*1 side of the bottom plate portion 21*a* of the sheet receiving tray 21 to perform the sheet sorting to be described later after the sheets P sequentially discharged from the sheet discharging unit fall.

In the end fence plate moving mechanism 80, the end fence plate 82 is integrally and fixedly attached to the second bracket 81 formed by using a metal plate material. The end fence plate 82 is provided to extend downward and be spaced away from the aforementioned offset guide plate 52 by a length of the sheets P in the sheet discharging direction DD. Moreover, the end fence plate 82 can be moved integrally with the second bracket 81 to the front and rear sides, according to the length size of the sheets P in the sheet discharging direction DD and can also be moved to the front and rear sides according to the offset amount in the sheet sorting.

In a lower rear portion of the end fence plate 82, the second sheet contacting members 83 (FIG. 2 and FIGS. 9 to 11(*b*)) are aligned with a rear face of the end fence plate 82 to aligning the front ends of the sheets P and are attached to be movable upward and downward by, for example, about 20 mm and to be movable downward by its own weight. The second sheet contacting members 83 can be moved upward by activating an electromagnetic solenoid (FIG. 2 and FIGS. 9 to 11(*b*)).

Here, the end fence plate 82 is movable in the front-rear direction but, unlike the offset guide plate 52, does not move in the up-down direction. The reason for this is because the sheet receiving tray 21 is lifted down according to the amount of stacked sheets in the sheet sorting to be described later and the end fence plate 82 thus maintains a constant height above the upper face plate portion 21*b* of the sheet receiving tray 21.

A moving mechanism for moving the end fence plate 82 integrally with the second bracket 81 is attached to the back surface of the top plate (not illustrated) covering the upper portion of the sheet sorting device 1.

Specifically, a second geared pulse motor 86 is attached to the back surface of the not-illustrated top plate via a second motor bracket 85 supported by the back surface to be rotatable in normal and reverse directions.

The rotation of the second geared pulse motor 86 is transmitted to a third timing pulley 87 on the front side. A second timing belt 91 is passed around the third timing pulley 87 on the front side and a fourth timing pulley 90 on the rear side, the fourth timing pulley 90 facing the pulley 87 at an interval and attached at its axis to a shaft 89 on a bracket 88 fixedly installed above the rear plate 2.

Between the third and fourth timing pulleys 87, 90 on the front and rear sides, two third and fourth guide shafts 92, 93 are supported on the left and right sides of the second timing belt 91 with the second timing belt 91 interposed therebetween, in parallel with the sheet discharging direction DD, below the second and first guide shafts 41, 42 provided in the aforementioned side fence plate opening-closing mechanism 30 so as not to collide with the second and first guide shafts 41, 42.

A slider 94 (FIG. 9) is connected to a top face plate 81*a* of the second bracket 81. The slider 94 is fitted to be slidable in the sheet discharging direction DD along the two third and fourth guide shafts 92, 93 and is connected to the left side of the second timing belt 91.

Accordingly, when the second geared pulse motor 86 is activated and the second timing belt 91 is turned in the normal direction, the second bracket 81 and the end fence plate 82 are integrally moved rearward (or forward). Meanwhile, when the second timing belt 91 is turned in the reverse direction, the second bracket 81 and the end fence plate 82 are integrally moved forward (or rearward).

The end fence plate 82 can be moved integrally with the second bracket 81 according to the length size of the sheets P in the sheet discharging direction DD. In addition, the stacked positions of the front ends of the sheets P stacked on the sheet receiving tray 21 in the sheet sorting to be described later can be offset by a predetermined offset amount in the sheet discharging direction DD.

Figure 9:
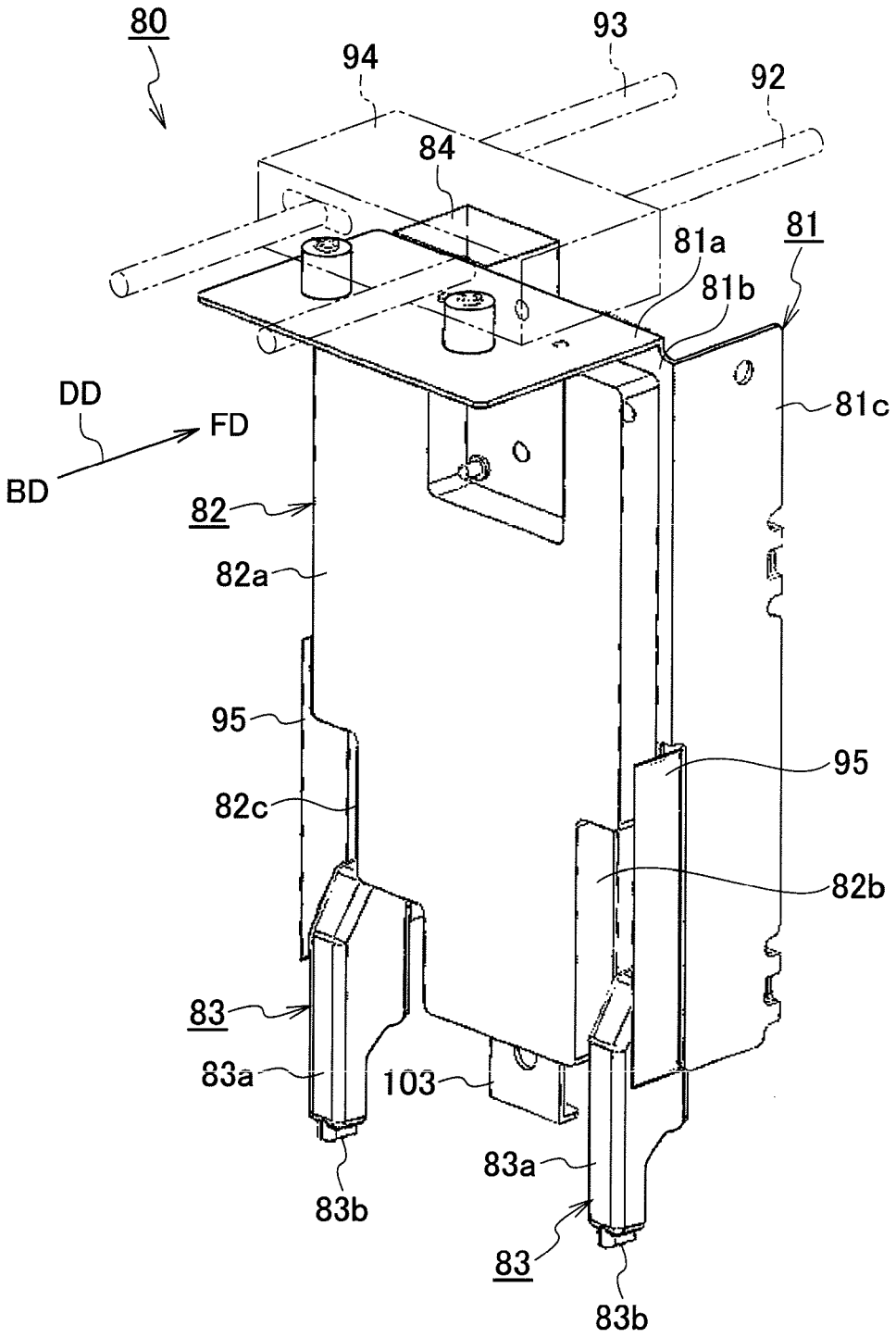
FIG. 9 is a perspective view of an end fence plate moving mechanism shown in FIGS. 1 and 2 as viewed from the rear side in the sheet discharging direction.
Figure 10:
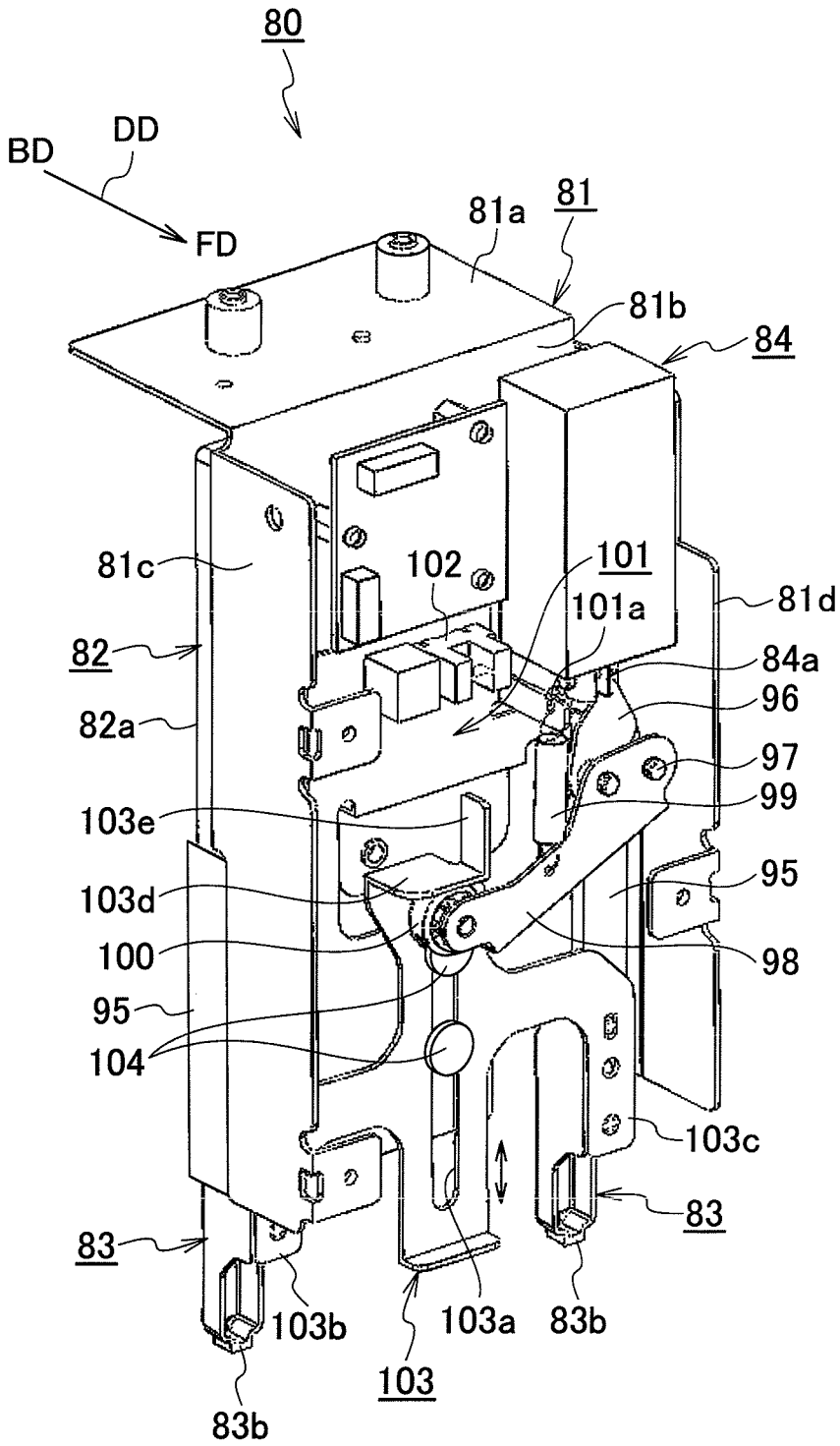
FIG. 10 is a perspective view of the end fence plate moving mechanism as viewed from a front side in the sheet discharging direction.
Figure 11:
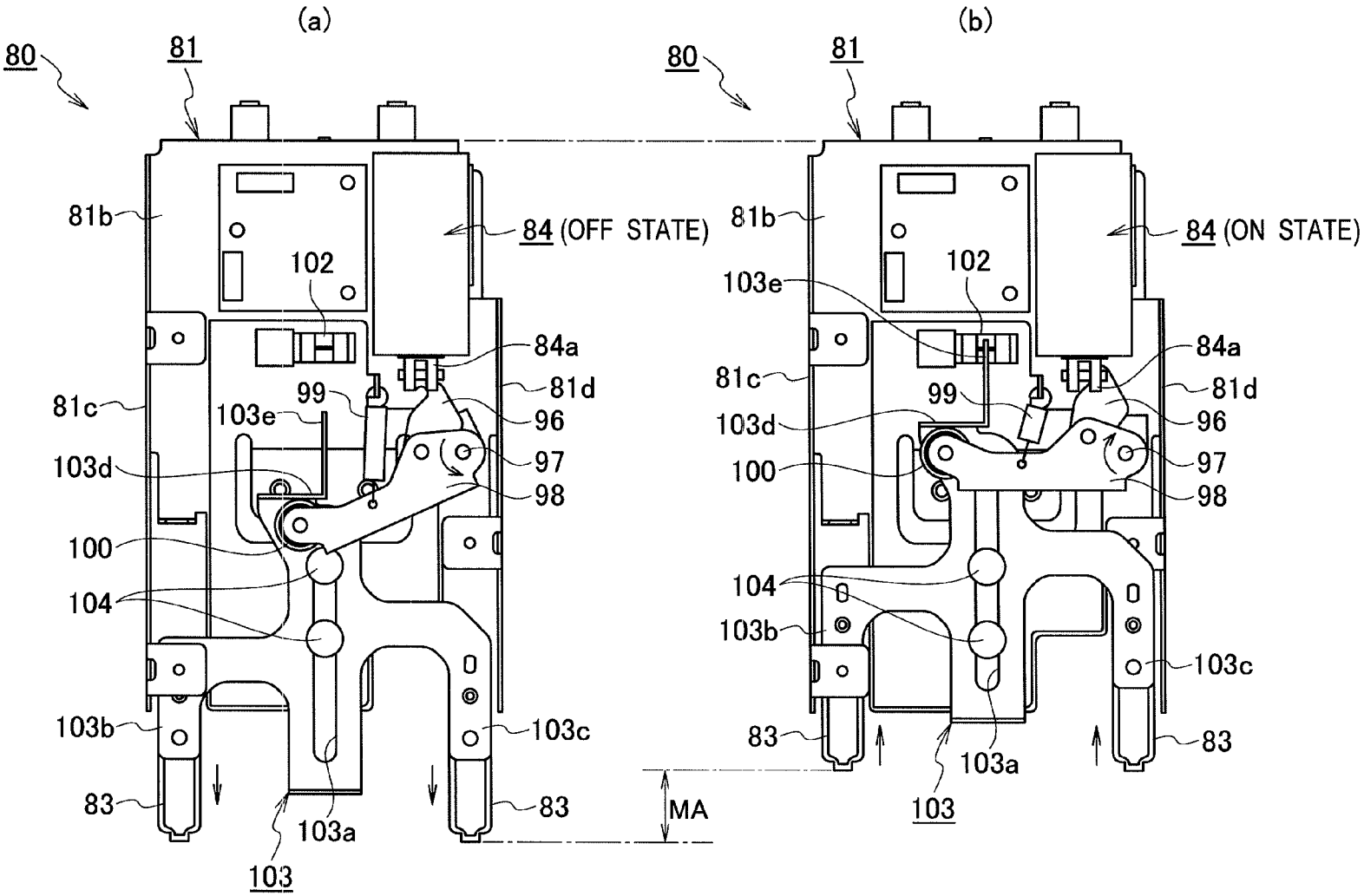
FIGS. 11(*a*) and 11(*b*) are views for explaining an operation of the end fence plate moving mechanism.

The end fence plate moving mechanism 80 is described specifically by using FIGS. 9 to 11(*b*).

FIGS. 9 to 11(*b*) are enlarged views for explaining the end fence plate moving mechanism 80 of the embodiment.

As shown in FIG. 9, in the second bracket 81 which is a base of the end fence plate moving mechanism 80, there are formed, by bending a metal plate material, the top face plate 81*a* connected to the slider 94 to which the two third and fourth guide shafts 92, 93 are fitted, a front face plate 81*b* continuously connected to the top face plate 81*a* in a vertical posture, and left and right side face plates 81*c*, 81*d* (FIGS. 10 and 11(*b*)).

The end fence plate 82 is fixedly and integrally attached to a rear surface of the front face plate 81*b* of the second bracket 81 in a vertical posture with a sheet holding surface 82*a* for holding the sheets P facing in the sheet discharging direction DD. The end fence plate 82 faces the offset guide plate 52 (FIGS. 1 to 3) at an interval.

In the end fence plate 82, a pair of left and right notch portions 82*b*, 82*c* are formed in a lower portion of the sheet holding surface 82*a* to be spaced away from each other to the left and right sides, by being cut out to extend downward.

The pair of left and right second sheet contacting members 83, 83 are provided along insides of the pair of left and right notch portions 82*b*, 82*c* formed in the end fence plate 82 to be movable upward and downward. The pair of left and right second sheet contacting members 83, 83 are fixedly and integrally attached to left and right portions of a slide plate 103 slidably provided on a front surface side of the front face plate 81*b* of the second bracket 81.

In each of the second sheet contacting members 83, a sheet holding surface 83*a* for holding the sheets P is aligned with the sheet holding surface 82*a* of the end fence plate 82. Semi-circular protruding portions 83*b*, 83*b* protrude downward from lower end portions of the pair of left and right second sheet contacting members 83, 83. The semi-circular protruding portions 83*b*, 83*b* are configured to gently come into contact with the top sheet P stacked on the sheet receiving tray 21 in the sheet sorting to be described later. Moreover, the semi-circular protruding portions 83*b*, 83*b* can come into contact with the first gap portions 21*c*, 21*d* (FIG. 1) formed in the left and right portions of the upper face plate portion 21*b* of the sheet receiving tray 21.

Antistatic brushes 95, 95 for removing electricity from the sheets P are fixedly attached to lower rear portions of the left and right side face plates 81*c*, (81*d*) of the second bracket 81.

In the end fence plate moving mechanism 80 shown in an enlarged manner in FIG. 10, the electromagnetic solenoid 84 which is an upward movement drive unit for simultaneously moving the pair of left and right second sheet contacting members 83, 83 upward is attached to an upper right portion of the front face plate 81*b* of the second bracket 81 on the front surface side with a movable iron core 84*a* facing downward.

One end of a linking plate 96 is connected to the movable iron core 84*a* of the electromagnetic solenoid 84. The other end of the linking plate 96 is connected to a portion of a lever 98 turning about a turning shaft 97, the portion being on the left side of the turning shaft 97.

One end of a tension spring 99 is hooked to an intermediate portion of the lever 98 and a roller 100 is supported at its axis by a left end portion of the lever 98. The outer end of the tension spring 99 is hooked to a spring hook piece 101*a* of a sensor supporting plate 101 fixedly attached to the front face of the front face plate 81*b* of the second bracket 81. The lever 98 is urged toward the electromagnetic solenoid 84 disposed above.

The slide plate 103 is provided below an optical sensor 102 attached to the sensor supporting plate 101 to be slidable in the up-down direction.

The slide plate 103 is formed by bending a metal plate material and an elongating vertical hole 103 guided by two guide pins 104 is formed in a center portion of the slide plate 103 in the width direction to penetrate the slide plate 103.

In the slide plate 103, arm pieces 103*b*, 103*c* for fixedly attaching the pair second sheet contacting members 83, 83 are formed in the left and right portions of the vertical hole 103*a* to extend downward. Moreover, a roller contact piece 103 with which the roller 100 comes in contact from below and an optical sensor detection piece 103*e* configured to advance into and retreat from the optical sensor 102 are formed above the vertical hole 103*a* by bending.

As shown in FIG. 11(*a*), when the electromagnetic solenoid 84 is in an off state, the lever 98 turns in the counterclockwise direction about the turning shaft 97 against the tension spring 99 due to the total weight of the movable iron core 84*a* of the electromagnetic solenoid 84, the linking plate 96, the lever 98, the roller 100, the slide plate 103, and the pair of left and right second sheet contacting members 83, 83 fixedly attached the slide plate 103.

The pair of left and right second sheet contacting members 83, 83 are moved downward integrally with the slide plate 103 by their own weight with this turning and the sensor detection piece 103*e* of the slide plate 103 is moved away from the optical sensor 102. The controller 110 thus determines that the pair of left and right second sheet contacting members 83, 83 are moved downward.

The pair of left and right second sheet contacting members 83, 83 fixedly attached to the slide plate 103 can thereby gently come into contact with the first gap portions 21*c*, 21*d* (FIG. 1) formed in the sheet receiving tray 21 on which no sheets P are stacked or the top sheet P stacked on the sheet receiving tray 21.

When the second sheet contacting members 83 come into contact with the top sheet P stacked on the sheet receiving tray 21 in the sheet sorting to be described later, the front end of the sheet P to be stacked next can be aligned by the second sheet contacting members 83 without a gap formed between the end fence plate 82 and the top sheet P stacked on the sheet receiving tray 21 and a front surface of the paper sheet P is not damaged.

Meanwhile, as shown in FIG. 11(*b*), when the electromagnetic solenoid 84 is in an on state, the movable iron core 84*a* of the electromagnetic solenoid 84 is pulled upward and the lever 98 is turned in the clockwise direction about the turning shaft 97 via the linking plate 96. Accordingly, the roller contact piece 103*d* of the slide plate 103 is pushed upward by the roller 100 supported about its axis by the left end portion of the lever 98.

Along with this turning, the pair of left and right second sheet contacting members 83, 83 fixedly attached to the slide plate 103 are moved upward and the sensor detection piece 103*e* of the slide plate 103 blocks the optical sensor 102. The controller 110 thus detects that the pair of left and right second sheet contacting members 83, 83 are moved upward.

The pair of left and right second sheet contacting members 83, 83 fixedly attached to the slide plate 103 can be thus moved away from the first gap portions 21*c*, 21*d* (FIG. 1) formed in the sheet receiving tray 21 on which no sheets P are stacked or the top sheet P stacked on the sheet receiving tray 21. In this case, a movement amount MA of the pair of left and right second sheet contacting members 83, 83 in the up-down direction is, for example, about 20 mm, as in the first sheet contacting member 53.

In summary, in the end fence plate moving mechanism 80, since the end fence plate 82 and the second sheet contacting members 83 align the front ends of the sheets P according to the length of the sheets P in the sheet discharging direction DD and the offset amount, the end fence plate 82 and the second sheet contacting members 83 are integrally moved forward or rearward by a predetermined offset amount for each sorted stack of sheets by the drive force of the second geared pulse motor 86 (FIG. 1). Moreover, the second sheet contacting members 83 are moved downward in the gravity direction by its own weight and are moved upward by using the electromagnetic solenoid 84 which is the upward movement drive unit.

In the embodiment, although the electromagnetic solenoid 84 is used as the upward movement drive unit for moving the second sheet contacting members 83 upward, the present invention is not limited to this configuration. For example, a device such as a laminated piezoelectric element or a motor can be used as the upward movement drive unit as long as the device has a shape and a structure capable of bringing the second sheet contacting members 83 gently into contact with the sheets P when the second sheet contacting members 83 are moved downward.

<Operations of Sheet Sorting Device 1>

Operations of the sheet sorting device 1 are described by using FIGS. 12 to 16B.

In the sheet sorting device 1, when the sheets P sequentially discharged from the sheet discharging unit 10 is stacked on the sheet receiving tray 21, the user has selected one of a normal mode or a sheet sorting mode in the not-illustrated image forming device.

Figure 12:
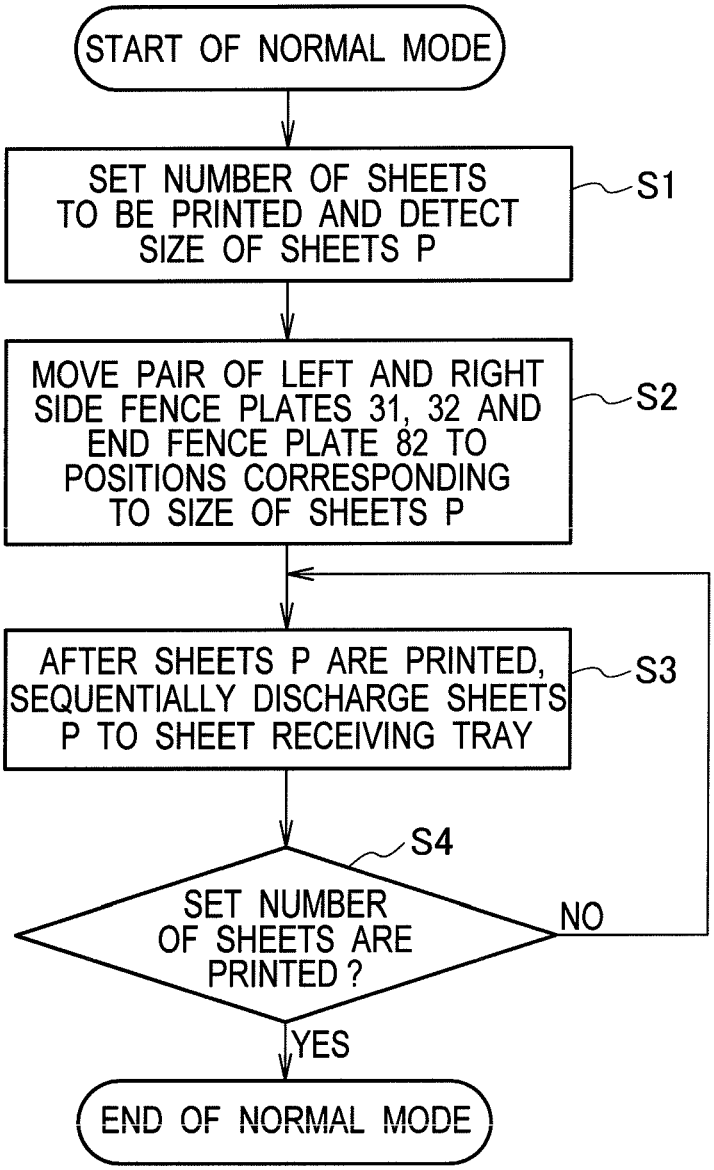
FIG. 12 is a flowchart for explaining an operation in a normal mode in the sheet sorting device in the embodiment of the present invention.
Figure 13:
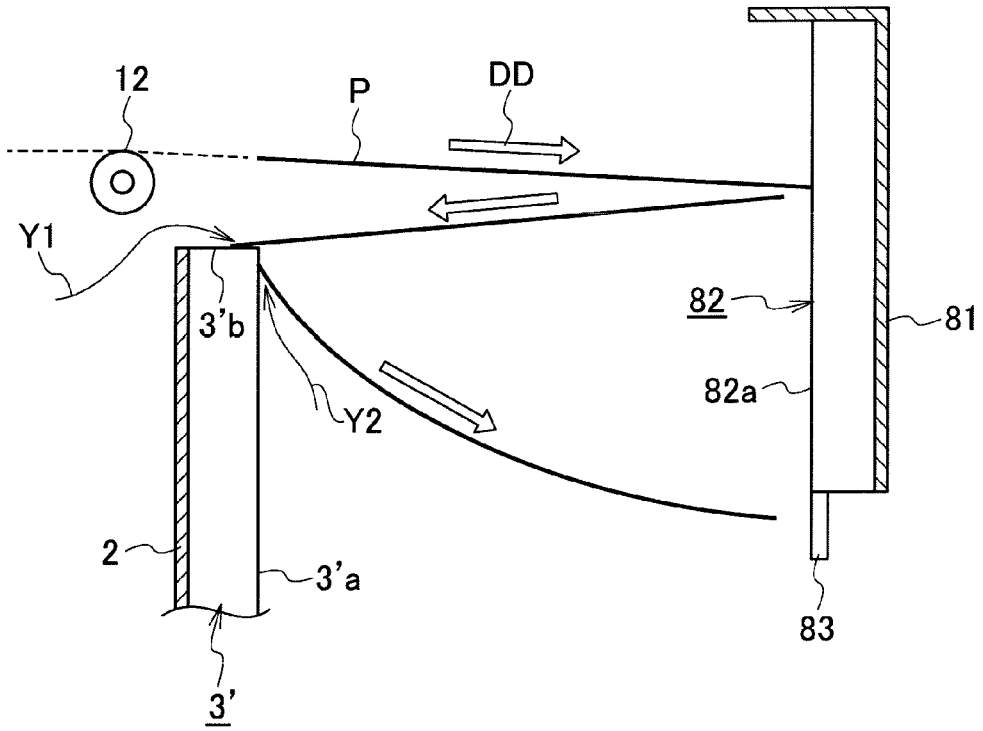
FIG. 13 shows a comparative example of the embodiment in the normal mode and is a vertical cross-sectional view schematically showing a state of a sheet discharged between the end fence plate and a sheet guide fence plate attached to a rear plate of the sheet sorting device.
Figure 14:
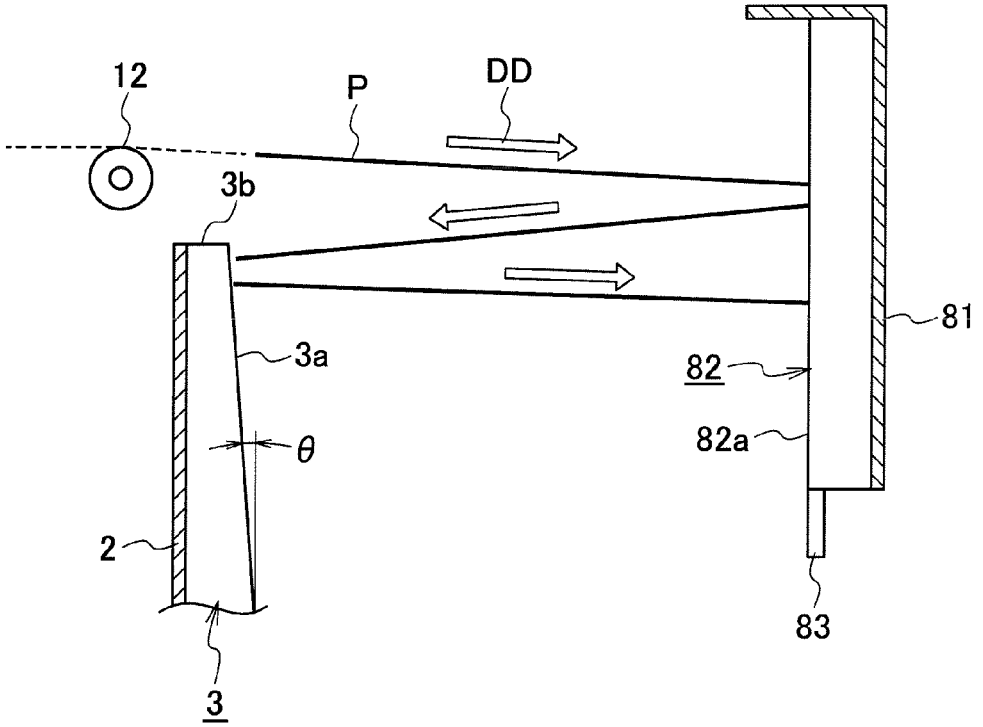
FIG. 14 shows the embodiment in the normal mode and is a vertical cross-sectional view schematically showing a state of the sheet discharged between the end fence plate and the sheet guide fence plate attached to the rear plate of the sheet sorting device.

First, an explanation is given of the normal mode. FIG. 12 shows an operation flow in the normal mode in the sheet sorting device 1 of the embodiment. Moreover, FIG. 13 shows a comparative example of the embodiment in the normal mode and schematically shows a state of the sheet P discharged between the end fence plate 82 and sheet guide fence plates 3' attached to the rear plate 2 of the sheet sorting device 1. Furthermore, FIG. 14 shows the embodiment in the normal mode and schematically shows a state of the sheet P discharged between the end fence plate 82 and the sheet guide fence plates 3 attached to the rear plate 2 of the sheet sorting device 1. In FIGS. 13 and 14, the lower side of the sheet is the sheet receiving tray 21 side.

As shown in FIG. 12, when the normal mode is started, for example, the number of sheets P to be printed is set in the not-illustrated image forming device and the size of the sheets P is detected in step S1.

Next, in step S2, the pair of left and right side fence plates 31, 32 and the end fence plate 82 are moved to positions corresponding to the size of the sheets P in the sheet sorting device 1.

Next, in step S3, after the sheets P are printed in the not-illustrated image forming device, the printed sheets P are sequentially discharged onto the sheet receiving tray 21 provided in the sheet sorting device 1 to be capable of being lifted up and down. In this case, the sheet receiving tray 21 is lifted down every time a predetermined number of sheets are stacked, so that the sheet falling height H (FIG. 2) of the stacked top sheet P can be substantially constant.

Next, in step S4, whether the set number of sheets are printed is determined. When the printing of the set number of sheets is not completed, the step returns to step S3. When the printing of the set number of sheets is completed, the operation flow of the normal mode is terminated.

When the operation in the normal mode is performed in the sheet sorting device 1, misalignment of the leading and rear ends of the sheets P are aligned by the sheet guide fence plates 3 (FIGS. 1 and 2) attached to the rear plate 2 of the device 1 on the upstream side in the sheet discharging direction DD and the end fence plate 82 facing the sheet guide fence plates 3 at an interval.

Meanwhile, in the comparative example of the embodiment in the normal mode which is shown in FIG. 13, the sheet guide fence plates 3' in which vertical sheet holding surfaces 3'*a* are formed are attached to the rear plate 2 of the device 1 in a vertical posture and the end fence plate 82 facing the sheet guide fence plates 3' at an interval is attached to the second bracket 81 in a vertical posture.

Here, in each sheet P discharged from the discharging roller 12 provided near the sheet discharging position, the front end in the sheet discharging direction DD hits the sheet holding surface 82*a* of the end fence plate 82 provided on the downstream side in the sheet discharging direction DD, and the sheet P bounce off to return to the upstream side in the sheet discharging direction DD by this hitting. In the returning of the sheet P, the rear end of the sheet P lands on upper end surfaces 3'*b* of the sheet guide fence plates 3' attached to the rear plate 2 on the upstream side in the sheet discharging direction DD in the vertical posture (the arrow Y1 of FIG. 13) or the rear end of the sheet P falls toward the sheet receiving tray 21 while leaning on the vertical sheet holding surfaces 3'*a* of the sheet guide fence plates 3' (the arrow Y2 of FIG. 13). Accordingly, there occurs a phenomenon in which sheet arrangement of the leading and rear ends of the sheets P on the sheet receiving tray 21 deteriorates and sheet jamming may occur in some cases.

In view of this, in the embodiment in the normal mode which is shown in FIG. 14, the sheet guide fence plates 3 in which sheet holding surfaces 3*a* inclined at the predetermined angle are formed are attached to the rear plate 2 of the device 1 and the end fence plate 82 facing the sheet guide fence plates 3 at an interval is attached to the second bracket 81 in a vertical posture.

Here, the sheet holding surfaces 3*a* of the sheet guide fence plates 3 are each formed in a tapered surface shape by being inclined at a predetermined angle θ which is, for example, about 3° with respect to the vertical line to make the thickness on an upper end surface 3*b* side smaller than that on a not-illustrated lower end surface side.

As described above by using FIG. 1, the multiple sheet guide fence plates 3 having the tapered-surface-shaped sheet holding surfaces 3*a* are attached to the rear plate 2 at intervals in the left-right symmetric manner about the center portion of the rear plate 2 in the sheet width direction WD.

Accordingly, in the embodiment, even when the front end of each sheet P discharged from the discharging roller 12 hits the sheet holding surface 82*a* of the end fence plate 82 and the sheet P returns to the upstream side in the sheet discharging direction DD due this hitting, the rear end of the sheet P does not land on the upper end surfaces 3*b* due to the inclination of the sheet holding surfaces 3*a* of the sheet guide fence plates 3 and falls toward the sheet receiving tray 21 along the taper-surface-shaped sheet holding surfaces 3*a*. Accordingly, the sheet arrangement of the leading and rear ends of the sheets P on the sheet receiving tray 21 is improved and the sheet stacking failure can be prevented.

Furthermore, when the sheets P are sorted and stacked at the first sheet stacking position set on the sheet receiving tray 21 in the sheet sorting mode to be described later, the sheet guide fence plates 3 align the rear ends of the sheets P in conjunction with the offset guide plate 52.

Although the illustration is omitted herein, there may be employed a structural mode in which the inclination angle of the sheet holding surfaces 3*a* of the sheet guide fence plates 3 is variably set according to the paper quality (thin paper, ordinary paper, thick paper) of the sheets P. For example, in the case of thick paper, the inclination angle of the sheet holding surfaces 3*a* is set to be large.

Although the illustration is omitted herein, there may be employed a structural mode in which the height of the upper end surfaces 3*b* of the sheet guide fence plates 3 is variably set according to the paper quality (thin paper, ordinary paper, thick paper) of the sheets P. For example, in a case of thin paper, the height of the upper end surfaces 3*b* is set to be high.

In FIGS. 13 and 14 described above, an explanation is given of the normal mode. In the sheet sorting mode to be described later, the offset guide plate 52 is used instead of the sheet guide fence plates 3 to align the rear ends of the sheets P. In this case, since the sheet holding surface 52*a* of the offset guide plate 52 is also formed in the tapered surface shape as described above by using FIG. 3, the sheet arrangement of the leading and rear ends of the sheets P can performed in an excellent manner between the offset guide plate 52 and the end fence plate 82 in the sheet sorting.

Figure 15:
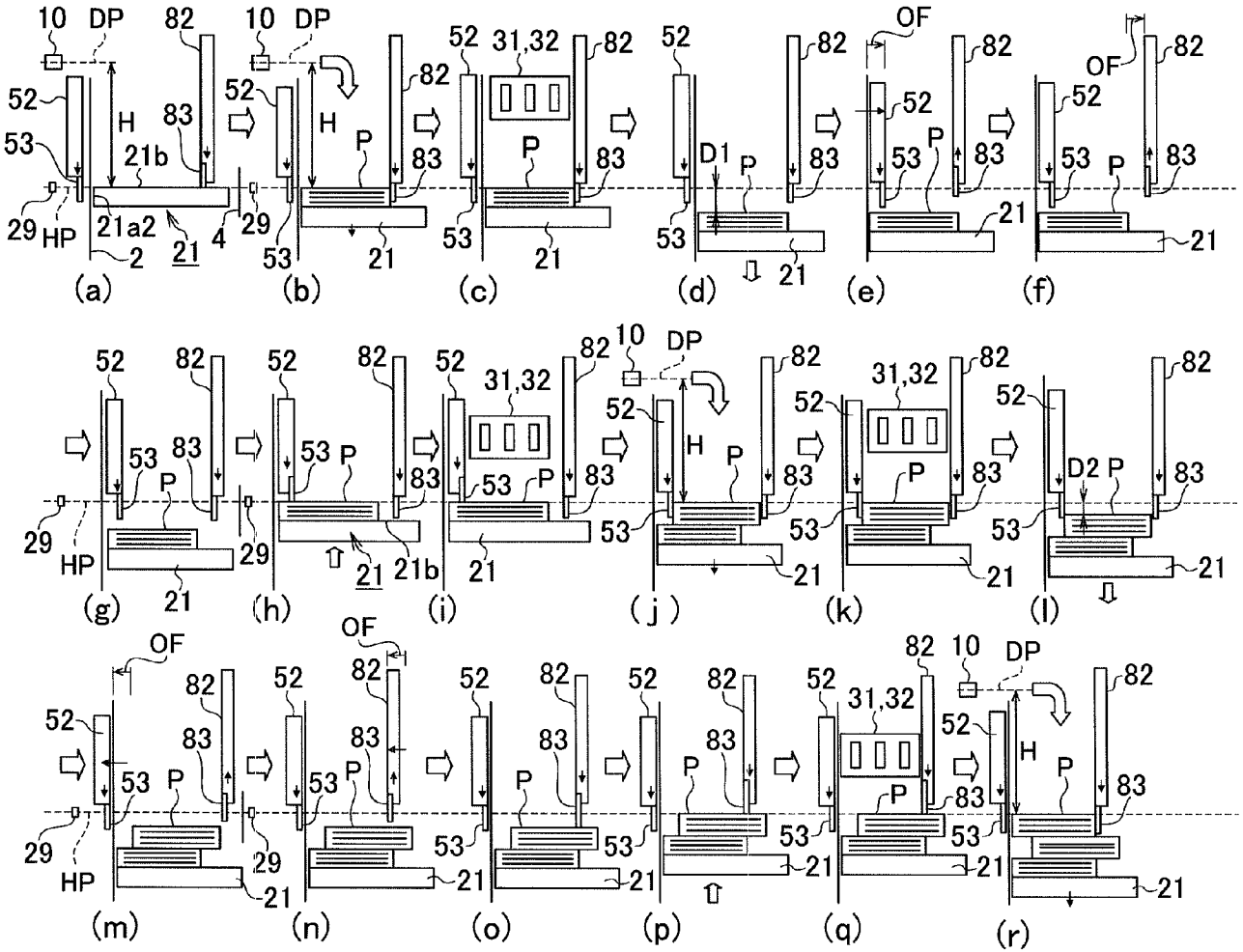
FIGS. 15(*a*) to 15(*r*) are operation diagrams for schematically showing and explaining operations of the sheet sorting device in the embodiment.

Next, the sheet sorting mode is explained in the order of operations by using operation diagrams to facilitate the understanding. FIGS. 15(*a*) to 15(*r*) schematically show operations in the sheet sorting mode in the sheet sorting device 1 of the embodiment in the order of operations.

In FIG. 15, the light-transmitting-type sheet height position detecting sensor 29 for detecting the height position of the upper face plate portion 21*b* of the sheet receiving tray 21 on which no sheets P are stacked or the sheet height position of the top sheet P stacked on the sheet receiving tray 21 is attached to the rear plate 2 and the front plate 4. Note that the sheet height position detecting sensor 29 is illustrated only in FIGS. 15(*a*), 15(*g*), and 15(*m*) for the sake of illustration and the illustration of the sheet height position detecting sensor 29 is omitted in other figures with the sheet height position illustrated in an one-dot chain line.

When many sheets P are to be sorted by using the sheet sorting device 1, the size of the sheets P is detected in advance in the not-illustrated image forming device and stored in the controller 110. Moreover, it is assumed that the lengths, in the sheet discharging direction DD, of the sheets P stacked on the upper face plate portion 21*b* of the sheet receiving tray 21 are the same.

A predetermined number of sheets per sorted-stack in which sheets P sequentially discharged from the sheet discharging unit 10 are sorted and stacked on the sheet receiving tray 21 is set in advance to be constant for all the sorted-stacks and the number of sorted-stacks is also set in advance. The predetermined number of sheets per sorted-stack and the number of sorted-stacks are stored in the controller 110.

When the sheets P sequentially discharged from the sheet discharging unit 10 is sorted in multiple stacks by being offset to the front and rear sides in the sheet discharging direction DD on the sheet receiving tray 21, the first sheet stacking position and the second sheet stacking position are set and stacking at the first sheet stacking position and stacking at the second sheet stacking position are alternately repeated.

In this case, the first sheet stacking position is a waiting position where the offset guide plate 52 and the end fence plate 82 facing the offset guide plate 52 at an interval equal to the length of the sheets P in the sheet discharging direction DD are waiting on the upstream side in the sheet discharging direction DD above the sheet receiving tray 21.

Meanwhile, in comparison with the first sheet stacking position, the second sheet stacking position is a position where the offset guide plate 52 and the end fence plate 82 are offset toward the downstream side in the sheet discharging direction DD by predetermined amounts above the sheet receiving tray 21.

In the multiple times of division, odd-number time sheet sorting is performed at the first sheet stacking position while even-number time sheet sorting is performed at the second sheet stacking position.

First, FIG. 15(*a*) shows a state before the sheets P are stacked on the sheet receiving tray 21 and the sheet receiving tray 21 waits at the waiting position.

Here, the height of the upper face plate portion 21*b* of the sheet receiving tray 21 on which no sheets P are stacked is detected by the light-transmitting-type sheet height position detecting sensor 29 attached to the rear plate 2 and the front plate 4 and the sheet receiving tray 21 thus waits at a position where the sheet falling height H from a discharge position DP of the sheets P discharged from the sheet discharging unit 10 to the upper face plate portion 21*b* of the sheet receiving tray 21 is substantially constant.

The offset guide plate 52 provided to extend downward on the rear plate 2 side waits for the first sheet sorting while being disposed above the upper face plate portion 21*b* of the sheet receiving tray 21 and extending substantially along the rear plate 2, slightly away from the rear face 21*a*2 of the bottom plate portion 21*a* of the sheet receiving tray 21, and can align the rear ends of the falling sheets P. At the same time, the first sheet contacting member 53 attached to the lower portion of the offset guide plate 52 is lowered toward the sheet receiving tray 21 by its own weight. Accordingly, the first sheet contacting member 53 can align the rear ends of the sheets P in the sheet discharging direction DD in conjunction with the offset guide plate 52.

The end fence plate 82 provided to extend downward on the front plate 4 side waits for the first sheet sorting while being disposed above the upper face plate portion 21*b* of the sheet receiving tray 21 at a position corresponding to the length, in the sheet discharging direction DD, of the sheets P to be stacked on the upper face plate portion 21*b*, and can align the front ends of the falling sheets P. At the same time, since the electromagnetic solenoid 84 (FIGS. 2 and 9 to 11(*b*)) is set to the off state, the second sheet contacting members 83 attached to the lower portion of the end fence plate 82 is lowered toward the sheet receiving tray 21 by their own weight and are in gentle contact with the sheet receiving tray 21. Accordingly, the second sheet contacting members 83 can align the front ends of the sheets P in the sheet discharging direction DD in conjunction with the end fence plate 82.

Next, FIG. 15(*b*) shows a state where the sheets P are discharged and the first sheet sorting is performed as an example of the odd-number time sheet sorting.

Here, the offset guide plate 52, the first sheet contacting member 53, the end fence plate 82, and the second sheet contacting members 83 are maintained at the same state as that shown in FIG. 15(*a*).

Accordingly, in the first sheet sorting, the sheet stacking position for the first sheet sorting (first sheet stacking position) is set between a set of the offset guide plate 52 and the first sheet contacting member 53 and a set of the end fence plate 82 and the second sheet contacting members 83.

Then, the sheets P sequentially discharged from the sheet discharging unit 10 fall between the offset guide plate 52 and the end fence plate 82 to be sequentially stacked on the upper face plate portion 21*b* of the sheet receiving tray 21. Here, the front ends of the stacked sheets P come into contact with the second sheet contacting members 83 and front end positions of the sheets P are aligned.

Moreover, the height position of the top sheet P stacked on the upper face plate portion 21*b* of the sheet receiving tray 21 is detected by the sheet height position detecting sensor 29 every time a preset number of sheets P are stacked, and the sheet receiving tray 21 is lifted down by the DC motor 26 (FIG. 1) in such a way that the sheet falling height H set between the discharge position DP of the sheets P and the top sheet P is substantially constant. The second sheet contacting members 83 are moved away from the upper face plate portion 21*b* of the sheet receiving tray 21 with the lifting down of the sheet receiving tray 21.

Thereafter, when the number of sheets P stacked on the upper face plate portion 21*b* of the sheet receiving tray 21 reaches the predetermined number of sheets per sorted-stack, the lifting down of the sheet receiving tray 21 is stopped and the first sheet sorting is completed.

Next, FIG. 15(*c*) shows a state where, as a previous step for performing the second sheet sorting, the pair of left and right side fence plates 31, 32 are opened, closed, and opened after the first sheet sorting is completed and the lifting down of the sheet receiving tray 21 is stopped.

Here, temporarily opening the pair of left and right side fence plates 31, 32 toward the outside of the left and right ends of the sheets P stacked on the sheet receiving tray 21 by a predetermined amount releases alignment of the left and right side ends of the sheets P by the pair of left and right side fence plates 31, 32. This can release the sheets P caught by the pair of left and right side fence plates 31, 32 in the sheet sorting, and eliminate sheet damage and sheet stacking misalignment due to oblique falling of a sheet.

The opening amount in the temporary opening of the pair of left and right side fence plates 31, 32 can be variably set according to the size of the paper sheets P or the paper quality (thin paper, ordinary paper, thick paper) of the sheets P. For example, the first geared pulse motor 35 (FIG. 1) can be pulse-controlled by the controller 110 to obtain a predetermined opening amount according to the size of the sheets P or the paper quality of the sheets P. The sheet stacking failure on the sheet receiving tray 21 can be thereby prevented according to the size of the sheets P or the paper quality of the sheets P.

In order to correct stacking displacement in the sheet width direction which occurs when the pair of left and right side fence plates 31, 32 are temporarily opened by the predetermined amount, the pair of left and right side fence plates 31, 32 are controlled to be closed again and opened one more time. The sheet stacking failure on the sheet receiving tray 21 is thereby surely prevented.

The execution and non-execution of the opening, closing, and opening operation of the pair of left and right side fence plates 31, 32 in FIG. 15(*c*) can be set according to the paper quality (thin paper, ordinary paper, thick paper) of the sheets P. For example, since thick paper with large stiffness is more likely to be caught by the pair of left and right side fence plates 31, 32, the opening-closing operation of the pair of left and right side fence plates 31, 32 can be set to be executed while no opening-closing operation is set to be executed for ordinary paper and thin paper which have smaller stiffness than the thick paper. The sheet stacking failure on the sheet receiving tray 21 can be thereby prevented according to the paper quality of the sheets P.

Next, FIG. 15(*d*) shows a state where, as a previous step for performing the second sheet sorting, the sheet receiving tray 21 is temporarily lifted down. Here, by temporarily lifting down the sheet receiving tray 21, the first sheet contacting member 53 and the second sheet contacting members 83 can be moved away from the top sheet P stacked on the sheet receiving tray 21 and subjected to the first sheet sorting.

In this case, at the first sheet stacking position, a first amount of lifting down D1 in the lifting down of the sheet receiving tray 21 after the operation of opening, closing, and opening the pair of left and right side fence plates 31, 32 is a distance between the sheet height position and the top sheet P stacked on the lifted-down sheet receiving tray 21.

Moreover, at the first sheet stacking position, since the first sheet contacting member 53 needs to come into contact with the top sheet P subjected to the sheet sorting at the first sheet stacking position in a subsequent step shown in FIG. 15(*e*) while the second sheet contacting members 83 is moved upward, the first amount of lifting down D1 of the sheet receiving tray 21 at the first sheet stacking position is set to a value so large that the first sheet contacting member 53 does not come into contact with the top sheet P on the lifted-down sheet receiving tray 21.

Next, in FIG. 15(*e*), as a previous step for performing the second sheet sorting, the offset guide plate 52 is moved to the lower right side (positive side) in the sheet discharging direction DD of the sheets P to be moved to the right by a predetermined offset amount OF which is, for example, about +30 mm and to be moved downward by about 5 mm. Moreover, the first sheet contacting member 53 is moved downward by its own weight. Meanwhile, the second sheet contacting members 83 are moved upward by the on operation of the electromagnetic solenoid 84 (FIG. 2 and FIGS. 9 to 11(*b*))

Then, in FIG. 15(*f*), as a previous step for performing the second sheet sorting, the end fence plate 82 is moved to the right side (positive side) in the sheet discharging direction DD of the sheets P by the predetermined offset amount OF which is, for example, about +30 mm, with the second sheet contacting members 83 moving upward.

Subsequently, in FIG. 15(*g*), as a previous step for performing the second sheet sorting, the electromagnetic solenoid 84 (FIG. 2 and FIGS. 9 to 11(*b*)) is set to the off state and the second sheet contacting members 83 are moved downward by their own weight.

Next, in FIG. 15(*h*), as a previous step for performing the second sheet sorting, the sheet receiving tray 21 is lifted up in such a way that the top sheet P on the lifted-down sheet receiving tray 21 reaches the sheet height position. The amount of lifting up of the sheet receiving tray 21 is such that the sheet receiving tray 21 is lifted up by an amount equal to the first amount of lifting down D1 of the sheet receiving tray 21 described in FIG. 15(*d*).

Then, by the lifting up of the sheet receiving tray 21, the first sheet contacting member 53 is made to gently come into contact with the top sheet P stacked on the sheet receiving tray 21 and subjected to the first sheet sorting, and the second sheet contacting members 83 are moved close to the upper face plate portion 21*b* of the sheet receiving tray 21. The sheet stacking position for the second sheet sorting (second sheet stacking position) is thus set between the offset guide plate 52 and the end fence plate 82 which are both offset to the right side.

Next, in FIG. 15(*i*), as a previous step for performing the second sheet sorting, the pair of left and right side fence plates 31, 32 opened in the step of FIG. 15(*c*) are closed again. The pair of left and right side fence plates 31, 32 can thus align the left and right side ends of the sheets P when the second sheet sorting is performed in the subsequent step shown in FIG. 15(*j*). When no opening operation of the pair of left and right side fence plates 31, 32 is executed in FIG. 15(*c*), the step of FIG. 15(*i*) is unnecessary.

Next, in FIG. 15(*j*), the sheets P are again sequentially discharged from the sheet discharging unit 10 and the second sheet sorting is performed. The sheets P subjected to the second sheet sorting are thereby stacked on the top sheet P subjected to the first sheet sorting while being offset to the right side by, for example, about 30 mm.

Next, states shown in FIGS. 15(*k*) to 15(*q*) show previous steps for performing the third sheet sorting. Here, only points which are different from the previous steps for performing the second sheet sorting are described and operations which are the same as those of the previous steps for performing the second sheet sorting are omitted and are shown only in illustrations.

Among the previous steps for performing the third sheet sorting, the steps of FIGS. 15(*l*), 15(*m*), 15(*n*), and 15(*p*) are different from the previous steps for performing the second sheet sorting. Note that the step of FIG. 15(*k*), the step of FIG. 15(*o*), and the step of FIG. 15(*q*) which are the operations same as those of the previous steps for performing the second sheet division correspond respectively to the step of FIG. 15(*c*), the step of FIG. 15(*g*), and the step of FIG. 15(*i*).

FIG. 15(*l*) shows state where, as a previous step for performing the third sheet sorting, the sheet receiving tray 21 is lifted down. Here, at the second sheet stacking position, a second amount of lifting down D2 in the lifting down of the sheet receiving tray 21 after the operation of opening, closing, and opening the pair of left and right side fence plates 31, 32 is set to a value smaller than the first amount of lifting down D1 of the sheet receiving tray 21 at the first sheet stacking position described above in FIG. 15(*d*).

The reason for this is as follows. In a subsequent step shown in FIG. 15(*m*), there is no need to bring the first sheet contacting member 53 into contact with the top sheet P subjected to the sheet sorting at the second sheet stacking position and the first sheet contacting member 53 is returned to the waiting position in conjunction with the offset guide plate 52 while the second sheet contacting members 83 are moved upward. Since the second amount of lifting down D2 of the sheet receiving tray 21 at the second sheet stacking position can be set to a value smaller than the first amount of lifting down D1 at the first sheet stacking position without consideration about the contact of the first and second sheet contacting members 53, 83 with the top sheet P on the lifted-down sheet receiving tray 21, the sheet sorting time can be reduced.

In FIG. 15(*m*), the offset guide plate 52 is moved by the predetermined offset amount OF to the oblique lower left side (negative side) and the second sheet contacting members 83 are moved upward.

In FIG. 15(*n*), the end fence plate 82 is moved to the left side (one side) by the predetermined offset amount OF with the second sheet contacting members 83 moved upward.

In FIG. 15(*p*), the sheet receiving tray 21 is lifted up in such a way that the top sheet P on the lifted-down sheet receiving tray 21 reaches the sheet height position. The amount of lifting up of the sheet receiving tray 21 is such that the sheet receiving tray 21 is lifted up by an amount equal to the second amount of lifting down D2 of the sheet receiving tray 21 described in FIG. 15(*l*).

Then, the lifting up of the sheet receiving tray 21 drives the second sheet contacting members 83 to gently come into contact with the top sheet P stacked on the sheet receiving tray 21 and subjected to the second sheet sorting.

The sheet stacking position for the third sheet sorting (first sheet stacking position) is thus set between the offset guide plate 52 which is moved to the left by about −30 mm and upward by about 5 mm and the end fence plate 82 which is moved to the left by about −30 mm, and the offset guide plate 52 and the end fence plate 82 return to the same waiting positions as those in the first sheet sorting.

Thereafter, in FIG. 15(*r*), the third sheet sorting can be performed by discharging the sheets P again.

Hereafter, when the sheet sorting is to be repeatedly performed multiple times, the stacking positions of the sheets P sorted and stacked on the sheet receiving tray 21 can be offset to the front and rear sides with respect to the sheet discharging direction DD, by moving the offset guide plate 52 and the end fence plate 82 alternately to the rear and front sides with respect to the sheet discharging direction DD by the predetermined offset amount for each sorted stack of sheets.

When the number of sorted-stacks reaches the preset number of sorted-stacks, all sheet sorting is completed.

In the sheet sorting mode shown in FIGS. 15(*a*) to 15(*r*) described above, particularly, after every time the sheet sorting is completed at the first or second sheet stacking position, the controller 110 (FIGS. 1 and 2): temporarily opens the pair of side fence plates 31, 32 in such a way that the pair of side fence plates 31, 32 move away from both side ends of the sheets P in the width direction; thereafter temporarily lifts down the sheet receiving tray 21 and offsets the offset guide plate 52 and the end fence plate 82; then closes the pair of side fence plates 31, 32 again after lifting up the sheet receiving tray 21. Accordingly, when the pair of side fence plates 31, 32 are temporarily opened, the alignment on both side ends of the sheets P in the width direction by the pair of side fence plates 31, 32 is released. This can release the sheets P caught by the pair of left and right side fence plates 31, 32 in the sheet sorting, and eliminate sheet damage and sheet stacking misalignment due to oblique falling of sheets.

In the offset of the set of the offset guide plate 52 and the first sheet contacting member 53 and the set of end fence plate 82 and the second sheet contacting members 83 which is performed after each time the sheet sorting at the first or second sheet stacking positions is completed, the controller 110 sets the amount of lifting down D2 and the amount of lifting up of the sheet receiving tray 21 at the second sheet stacking position to values smaller than the amount of lifting down D1 and the amount of lifting up of the sheet receiving tray 21 at the first sheet stacking position. Accordingly, the time for lifting down and up of the sheet receiving tray 21 at the second sheet stacking position can be reduced compared to those at the first sheet stacking position. Moreover, since the total offset moving time is reduced, the productivity of the sheet sorting device 1 can be improved.

The controller 110 controls the interval between start of sheet discharge to the first sheet stacking position and start of sheet discharge to the second sheet stacking position, according to the amounts of lifting down and the amounts of lifting up of the sheet receiving tray 21 at the first and second sheet stacking positions. Accordingly, the sheets P can be reliably discharged in a timely manner to the first and second sheet stacking positions set on the sheet receiving tray 21.

Figure 16B:
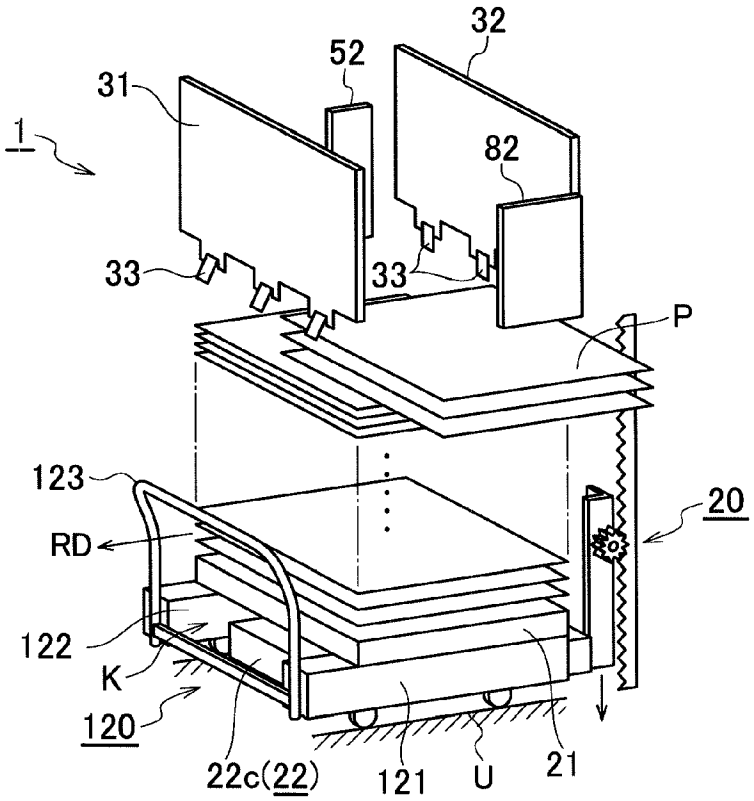
FIGS. 16A and 16B are perspective views each showing a state where a truck is used to take out the sheets stacked on the sheet receiving tray from the device, from the left side in a sheet width direction.
Figure 16A:
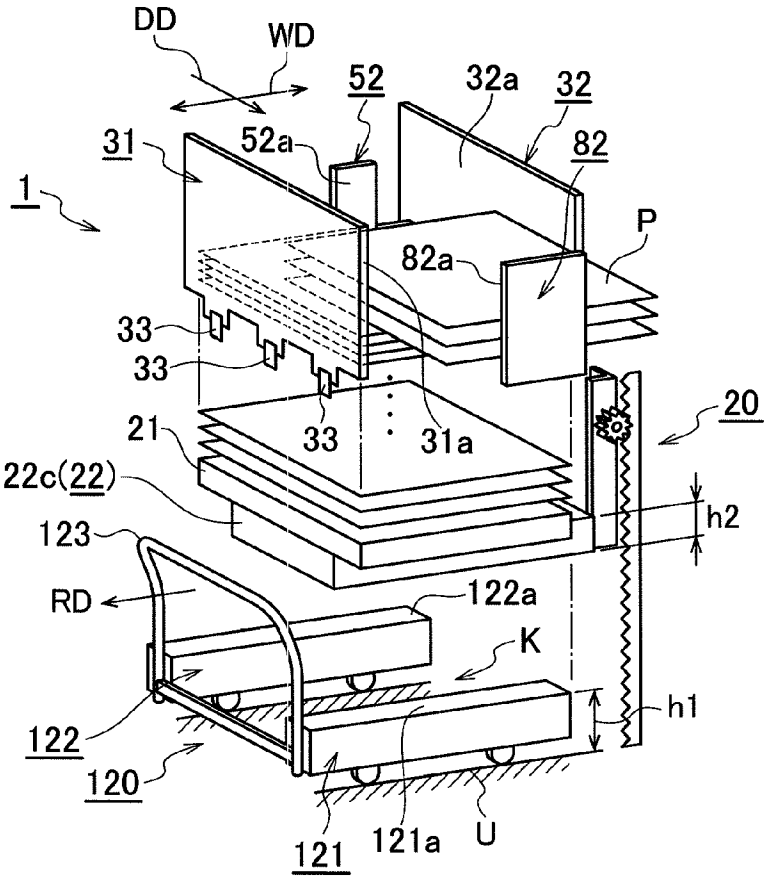

Next, a description is given of a case where the sheets P stacked on the sheet receiving tray 21 are taken out from the device 1 in the sheet sorting device 1. FIGS. 16A and 16B show, in a perspective manner, a state where the sheets P stacked on the sheet receiving tray 21 are taken out from the device 1, from the left side in the sheet width direction WD, by using a truck 120.

First, FIG. 16A shows, in a perspective view, a state where the sheets P are sorted by the sheet sorting device 1. The sheet receiving tray 21 is attachably and detachably mounted on the supporting base portion 22*c* of the sheet receiving tray supporter 22 which is lifted up and down by the sheet receiving tray lifting mechanism 20, while being set at a certain position by using a not-illustrated positioning pin provided on the supporting base portion 22*c*. The sheet receiving tray 21 is disposed on the upper side together with the supporting base portion 22*c*.

The top sheet P among the many sheets P stacked on the sheet receiving tray 21 is aligned by: the sheet holding surfaces 31*a*, 32*a* facing each other at an interval in the pair of left and right side fence plates 31, 32 moved to positions corresponding to the width size of the sheet P; the sheet holding surface 52*a* facing in the sheet discharging direction DD in the offset guide plate 52; and the sheet holding surface 82*a* facing in the opposite direction to the sheet discharging direction DD in the end fence plate 82 moved to a position corresponding to the length size of the sheet P in the discharging direction of the sheet P. Accordingly, the many sheets P cannot be taken out from the device 1.

The multiple extended fence members 33 are turnably supported in a lower portion of at least the left side fence plate 31 out of the pair of left and right side fence plates 31, 32.

The truck 120 is prepared in advance on a floor surface U below the supporting base portion 22*c* of the sheet receiving tray supporter 22. In the truck 120, a pair of wheeled arm bases 121, 122 face each other at an interval and are provided on the floor surface U to extend in the sheet width direction WD, and a handle 123 is attached to one ends of the pair of wheeled arm bases 121, 122.

The left side fence plate 31 side is set to be a sheet take-out direction (truck pull-out direction) along the sheet width direction WD.

The supporting base portion 22*c* of the sheet receiving tray supporter 22 can enter a space K formed between the pair of wheeled arm bases 121, 122. Moreover, the height h1 from upper surfaces 121*a*, 122*a* of the pair of wheeled arm bases 121, 122 to the floor surface U is set to be higher than the height h2 of the supporting base portion 22*c* of the sheet receiving tray supporter 22. The sheet receiving tray 21 whose external size is larger than that of the supporting base portion 22*c* of the sheet receiving tray supporter 22 can be mounted on the upper surfaces 121*a*, 122*a* of the pair of the wheeled arm bases 121, 122.

Meanwhile, FIG. 16B shows a state where the supporting base portion 22*c* of the sheet receiving tray supporter 22 is lifted down to the lowest position by the sheet receiving tray lifting mechanism 20 after the sheets P are sorted by the sheet sorting device 1. The top sheet P among the many sheets P stacked on the sheet receiving tray 21 reaches a position below turning shafts (not illustrated) of the multiple extended fence members 33 turnably supported in the lower portion of the left side fence plate 31.

Here, when the supporting base portion 22*c* of the sheet receiving tray supporter 22 is lifted down to the lowest position, the supporting base portion 22*c* enters the space K formed between the pair of wheeled arm bases 121, 122 of the truck 120 while the sheet receiving tray 21 is mounted on the pair of wheeled arm bases 121, 122. A gap of dimension h1-dimension h2 is thereby formed between a lower surface of the sheet receiving tray 21 and an upper surface of the supporting base portion 22*c* and the sheet receiving tray 21 is thus separated from the sheet receiving tray lifting mechanism 20.

Accordingly, when the user pulls out the truck 120 in the truck pull-out direction while holding the handle 123, the multiple extended fence members 33 are pushed by a pile of the many sheets P stacked on the sheet receiving tray 21 and thus turn in the sheet take-out direction. The many sheets P can be thus easily taken out from the device 1, from the left side in the sheet width direction WD.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A sheet sorting device comprising:

a sheet receiving tray configured to stack sheets sequentially discharged and falling from an image forming device alternately at a first sheet stacking position and at a second sheet stacking position offset downstream of the first sheet stacking position by a predetermined amount in a sheet discharging direction;

a pair of side fence plates provided in parallel with the sheet discharging direction above the sheet receiving tray, to face each other at an interval and to be movable in a sheet width direction orthogonal to the sheet discharging direction, the side fence plates being configured to align both side ends, in the sheet width direction, of the sheets stacked on the sheet receiving tray;

a side fence plate opening-closing unit configured to selectively open and close the pair of side fence plates between a position where the pair of side fence plates are away from the both side ends, in the sheet width direction, of the sheets stacked on the sheet receiving tray and a position where the pair of side fence plates are in contact with the both side ends, in the sheet width direction, of the sheets stacked on the sheet receiving tray;

an offset guide plate movably installed at a position above the sheet receiving tray and configured to align rear ends, in the sheet discharging direction, of the sheets stacked on the sheet receiving tray;

an offset guide plate moving unit configured to offset the offset guide plate to locations for the first sheet stacking position and the second sheet stacking position;

an end fence plate provided above the sheet receiving tray to face the offset guide plate at an interval equal to a length of the sheets in the sheet discharging direction and to be movable in the sheet discharging direction, the end fence plate being configured to align front ends, in the sheet discharging direction, of the sheets stacked on the sheet receiving tray;

an end fence plate moving unit configured to offset the end fence plate to locations for the first sheet stacking position and the second sheet stacking position;

a sheet receiving tray lifting unit configured to liftably support the sheet receiving tray; and a controller configured to control the side fence plate opening-closing unit, the offset guide plate moving unit, the end fence plate moving unit, and the sheet receiving tray lifting unit, wherein the controller is configured to:

(a) while the sheets are discharged from the image forming device and are stacked on the sheet receiving tray at the first and second sheet stacking positions, drive the sheet receiving tray lifting unit to lower the sheet receiving tray downward to keep a constant falling height of a top sheet stacked on the sheet receiving tray;

(b) after each time when stacking of the sheets at the first sheet stacking position is completed and when the second sheet stacking position is completed, drive the side fence plate opening-closing unit to temporarily open the pair of side fence plates under a prescribed condition to move the pair of side fence plates away from the both side ends, in the sheet width direction, of the sheets;

(c) after the step (b), drive the sheet receiving tray lifting unit to temporarily lower the sheet receiving tray downward;

(d) after the step (c), drive the offset guide plate moving unit to offset the offset guide plate and drive the end fence plate moving unit to offset the end fence plate;

(e) after the step (d), drive the sheet receiving tray lifting unit to lift the sheet receiving tray up; and (f) after the step (e), drive the side fence plate opening-closing unit to close the pair of side fence plates to bring the pair of side fence plates into contact with the both side ends, in the sheet width direction, of the sheets again.

2. The sheet sorting device according to claim 1, wherein an opening amount for temporarily opening the pair of side fence plates depends on one of a size or a paper quality of the sheets to be discharged.

3. The sheet sorting device according to claim 1, wherein the prescribed condition includes a paper quality of the sheets to be discharged.

4. A sheet sorting device comprising:

a sheet receiving tray configured to stack sheets sequentially discharged and falling from an image forming device alternately at a first sheet stacking position and at a second sheet stacking position offset downstream of the first sheet stacking position by a predetermined amount in a sheet discharging direction;

an offset guide plate movably installed at a position above the sheet receiving tray and configured to align rear ends, in the sheet discharging direction, of the sheets stacked on the sheet receiving tray;

a first sheet contacting member movably attached to a lower portion of the offset guide plate and configured to be lowered toward the sheet receiving tray to align the rear ends, in the sheet discharging direction, of the sheets in conjunction with the offset guide plate;

an offset guide plate moving unit configured to offset the offset guide plate and the first sheet contacting member to locations for the first sheet stacking position and the second sheet stacking position;

an end fence plate provided above the sheet receiving tray to face the offset guide plate at an interval equal to a length of the sheets in the sheet discharging direction and to be movable in the sheet discharging direction, the end fence plate being configured to align front ends, in the sheet discharging direction, of the sheets stacked on the sheet receiving tray;

a second sheet contacting member moveably attached to a lower portion of the end fence plate and configured to be lowered toward the sheet receiving tray to align the front ends, in the sheet discharging direction, of the sheets in conjunction with the end fence plate;

an end fence plate moving unit configured to offset the end fence plate and the second sheet contacting member to locations for the first sheet stacking position and the second sheet stacking position;

a sheet receiving tray lifting unit configured to liftably support the sheet receiving tray; and a controller configured to control the offset guide plate moving unit, the end fence plate moving unit, and the sheet receiving tray lifting unit, wherein the controller is configured to:

(a) while the sheets are delivered from the image forming device and are stacked on the sheet receiving tray at the first and second sheet stacking positions, drive the sheet receiving tray lifting unit to lower the sheet receiving tray downward to keep a constant falling height of a top sheet stacked on the sheet receiving tray;

(b) after stacking of the sheets at the first sheet stacking position is completed, drive the sheet receiving tray lifting unit to temporarily lower the sheet receiving tray downward by a first amount;

(c) after the step (b), drive the offset guide plate moving unit to offset the offset guide plate and the first sheet contacting member and drive the end fence plate moving unit to offset the end fence plate and the second sheet contacting member;

(d) after the step (c), drive the sheet receiving tray lifting unit to lift the sheet receiving tray up by the first amount;

(e) after stacking of the sheets at the second sheet stacking position is completed, drive the sheet receiving tray lifting unit to temporarily lower the sheet receiving tray downward by a second amount smaller than the first amount;

(f) after the step (e), drive the offset guide plate moving unit to offset the offset guide plate and the first sheet contacting member and drive the end fence plate moving unit to offset the end fence plate and the second sheet contacting member; and (g) after the step (f), drive the sheet receiving tray lifting unit to lift the sheet receiving tray up by the second amount.

5. The sheet sorting device according to claim 4, wherein an interval between a start of sheet discharge to the first sheet stacking position and a start of sheet discharge to the second sheet stacking position depends on a difference between the first amount and the second amount.

* * * * *